US009864322B2

(12) United States Patent
Yoshihara et al.

(10) Patent No.: US 9,864,322 B2
(45) Date of Patent: Jan. 9, 2018

(54) IMAGE FORMING APPARATUS

(71) Applicants: Mayumi Yoshihara, Kanagawa (JP); Koichi Kato, Kanagawa (JP)

(72) Inventors: Mayumi Yoshihara, Kanagawa (JP); Koichi Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/159,960

(22) Filed: May 20, 2016

(65) Prior Publication Data

US 2016/0363886 A1 Dec. 15, 2016

(30) Foreign Application Priority Data

Jun. 9, 2015 (JP) ..... 2015-116862
Feb. 15, 2016 (JP) ..... 2016-025773

(51) Int. Cl.

| | |
|---|---|
| ***G03G 21/08*** | (2006.01) |
| ***G03G 15/04*** | (2006.01) |
| ***G03G 15/00*** | (2006.01) |
| ***G03G 5/06*** | (2006.01) |
| ***G03G 5/147*** | (2006.01) |

(52) U.S. Cl.

CPC ..... *G03G 21/08* (2013.01); *G03G 5/0679* (2013.01); *G03G 5/0696* (2013.01); *G03G 5/14756* (2013.01); *G03G 15/04045* (2013.01); *G03G 15/75* (2013.01)

(58) Field of Classification Search

CPC ..... G03G 21/08; G03G 5/00–5/16
See application file for complete search history.

(56) References Cited

U.S. PATENT DOCUMENTS 5,576,810 A * 11/1996 Aita ..... G03G 15/326 347/129
5,915,150 A * 6/1999 Kukimoto ..... G03G 9/0819 399/149
6,136,483 A * 10/2000 Suzuki ..... G03G 5/047 399/297

(Continued)

FOREIGN PATENT DOCUMENTS

JP 7-175241 7/1995
JP 8-160677 6/1996

(Continued)

*Primary Examiner* — Carla Therrien
(74) *Attorney, Agent, or Firm* — Oblon, McClelland, Maier & Neustadt, L.L.P.

(57) ABSTRACT

An image forming apparatus includes an image bearer; a charging member to charge the surface of the image bearer; an irradiating member to irradiate the surface of the image bearer to form an electrostatic latent image on the surface of the image bearer; an developing member to develop the electrostatic latent image with a toner to form a visible toner image on the surface of the image bearer; and a transferring member to transfer the toner image onto a transfer material. The image bearer includes a charge generation layer including an asymmetrical disazo pigment and a metal-free phthalocyanine pigment, and a charge transport layer. The irradiating member forms the electrostatic latent image at an irradiation energy greater than a half decay exposure of the image bearer and not greater than 2.5 times of the half decay exposure. The image bearer is not discharged every image forming process.

7 Claims, 5 Drawing Sheets

(56) References Cited

U.S. PATENT DOCUMENTS

| | | | | |
|---|---|---|---|---|
| 6,265,123 | B1 * | 7/2001 | Kakui | G03G 5/0696 430/129 |
| 2004/0126139 | A1 * | 7/2004 | Yoshizawa | G03G 21/0035 399/149 |
| 2004/0214101 | A1 * | 10/2004 | Suzuki | G03G 5/0696 430/59.2 |
| 2005/0141917 | A1 | 6/2005 | Enoki et al. | |
| 2008/0069588 | A1 * | 3/2008 | Inaba | G03G 15/011 399/116 |
| 2008/0107447 | A1 * | 5/2008 | Patterson | G03G 21/08 399/128 |
| 2009/0169227 | A1 * | 7/2009 | Kanai | G03G 15/0266 399/128 |
| 2010/0232830 | A1 * | 9/2010 | Wada | C09B 67/0016 399/111 |
| 2010/0232831 | A1 | 9/2010 | Fujiwara et al. | |
| 2010/0329741 | A1 | 12/2010 | Nohsho et al. | |
| 2013/0259538 | A1 * | 10/2013 | Watanabe | G03G 15/04027 399/270 |
| 2015/0093137 | A1 * | 4/2015 | Minami | G03G 15/0266 399/89 |

FOREIGN PATENT DOCUMENTS

| | | |
|---|---|---|
| JP | 9-288373 | 11/1997 |
| JP | 2000-147807 | 5/2000 |
| JP | 2002-107983 | 4/2002 |
| JP | 2013-037375 | 2/2013 |
| JP | 2014-197237 | 10/2014 |

* cited by examiner

CONVENTIONAL

IMAGE FORMING APPARATUS

CROSS-REFERENCE TO RELATED APPLICATIONS

This patent application is based on and claims priority pursuant to 35 U.S.C. §119 to Japanese Patent Applications Nos. 2015-116862 and 2016-025773, filed on Jun. 9, 2015 and Feb. 15, 2016, respectively in the Japan Patent Office, the entire disclosure of which is hereby incorporated by reference herein.

BACKGROUND

Technical Field

The present invention relates to an image forming apparatus.

Description of the Related Art

Electrophotographic image forming apparatuses such as copiers, printers and facsimiles typically include a photoconductor, and an irradiator, an image developer, a transferer, a cleaner and a discharger around the photoconductor.

Stable image formation is based on an idea that a photoconductor starts in the same condition at each cycle of the image forming processes, i.e., charging, irradiating, developing, transferring, cleaning and discharging.

Therefore, a photoconductor having a long life and a stable properties, and a process of initializing the photoconductor are needed. The initial status of the photoconductor is that the photoconductor is not charged and no untransferred toner remains on the surface of the photoconductor. Therefore, the surface of the photoconductor needs cleaning after a toner is transferred therefrom and discharging.

SUMMARY

An image forming apparatus includes an image bearer; a charging member to charge the surface of the image bearer; an irradiating member to irradiate the surface of the image bearer to form an electrostatic latent image on the surface of the image bearer; an developing member to develop the electrostatic latent image with a toner to form a visible toner image on the surface of the image bearer; and a transferring member to transfer the toner image onto a transfer material. The image bearer includes a charge generation layer including an asymmetrical disazo pigment and a metal-free phthalocyanine pigment, and a charge transport layer. The irradiating member forms the electrostatic latent image at an irradiation energy greater than a half decay exposure of the image bearer and not greater than 2.5 times of the half decay exposure. The image bearer is not discharged every image forming process.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
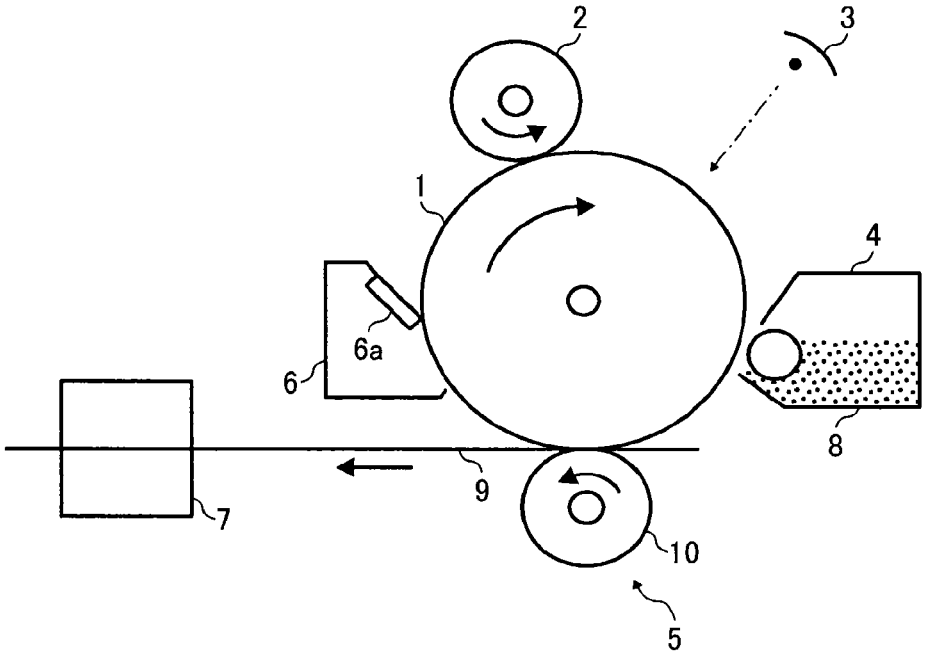
FIG. 1 is a schematic view illustrating an embodiment of the image forming apparatus of the present invention.

There is a need for providing an image forming apparatus producing no residual image caused by a latent image potential (residual potential) and is capable of accurately suppressing production of abnormal images.

In an electrophotographic image forming apparatus such as laser printers and facsimiles, the surface of an image bearer (photoconductor) is charged with a corona discharge, etc in a dark place, and irradiated with imagewise light to form an electrostatic latent image on the photoconductor.

The electrostatic latent image is visualized as a toner image by an image developer, and the toner image is finally transferred and fixed on a recording medium.

The toner remaining on the photoconductor after transferred is removed therefrom through a cleaning process, and the surface of the photoconductor is charged again to form an electrostatic latent image thereon.

Recently, the photoconductor has been expected to have higher durability, not to speak of sensitivity, electrical properties and optical properties in accordance with an electrophotographic process the photoconductor is applied to. Further, it is desirable to have a photoconductor capable of producing high-quality images for long periods.

The photoconductor has been desired to realize an image forming apparatus including a semiconductor laser or an LED (Light Emitting Diode) as a light source, and further to have wide spectral sensitivity from a visible range to an infrared range in terms of standardizing the photoconductor. Japanese Patent No. JP-3350834-B2 (Japanese published unexamined application No. JP-H07-175241-A) discloses using two or more pigments having spectral sensitivities at different wavelength ranges as charge generation materials used in a photoconductor. The photoconductor including two or more pigments as charge generation materials can be used in a wide range.

Meanwhile, the durability of the photoconductor depends on durability against mechanical loads such as abrasion and scratches on the surface of the photoconductor and electrical durability against accumulation of residual potential and deterioration of chargeability due to repeated optical fatigue. Various methods are developed to comply with the recent demand for higher durability. Further, various methods are developed to comply with increasing demands for downsizing image forming apparatus and simplifying image forming component elements in terms of saving space and reducing initial cost in addition to needs for higher quality images and higher speed.

Including a charger, an irradiator, an image developer, a fixer and a cleaner around a photoconductor, an image forming apparatus largely depends on the size of the photoconductor in size. Therefore, the photoconductor needs reducing occupational capacity to downsize the image forming apparatus. The image forming component elements can flexibly be arranged with a belt-shaped photoconductor, and a drum-shaped photoconductor has a smaller occupational capacity in the apparatus.

The photoconductor and each of the image forming component elements have advanced. Namely, a cleanerless system without a cleaner and a dischargeless system are considered to reduce initial cost.

However, most of them are limited to low-speed image forming apparatuses, high-speed apparatuses producing a large volume of images deteriorate in image quality when using such systems.

When the image forming apparatus is downsized, gaps among the elements arranged around the photoconductor are narrowed, and a gap between the discharger and the charger is not large. In compliance with a linear speed of the photoconductor, a residual potential thereof needs removing in a short time. As the liner speed becomes higher, the residual potential needs removing in shorter time.

However, the photoconductor is charged while retaining a residual potential occasionally, the photoconductor may produce abnormal images such as images having uneven image density because unstably or defectively charged and residual images because history of the former image is not cancelled.

Typically, since only a DC component is applied to the charger, the part retaining a residual potential is more highly charged. When a copy or a print entirely including uniform images is produced, the surface potential is not stabilized, resulting in production of images having uneven image density.

It is known overlapping an AC component on a DC component is effective to avoid uneven charge. As the apparatus and the photoconductor become smaller, a nip width becomes smaller. As the linear speed of the photoconductor becomes higher, a frequency of the AC component and/or a difference of voltage between the AC component and the DC component needs increasing.

As a result, repeated transfers and receptions of electrons between the surfaces of the photoconductor and the charger accelerates chemical deterioration such as a cut of the main chain of a binder resin of the surface of the photoconductor, resulting in larger abrasion thereof. The photoconductor is difficult to have higher durability when downsized and producing images at higher speed.

Prior to charging the photoconductor, some image forming apparatuses include a discharger irradiating light to the surface of the photoconductor and generates a carrier to remove a residual potential. The discharge light has a wavelength sensitive to a charge generation layer, and the entire surface of the photoconductor is irradiated to remove or cancel a surface potential.

This suppresses a difference of charge amount between a part having received imagewise light and an image history and a non-image part having received no imagewise light to suppress production of residual images.

Further, at present, an LED array is used as a light source of the discharger for downsizing, image density may be high at a part irradiated much and low at a part irradiated less.

In order to solve uneven image density due to nonuniform irradiation quantity, plural LED tips are densely located to uniformly irradiate the surface of the photoconductor at high illuminance.

However, a photosensitive layer is always irradiated and deteriorates in sensitivity due to optical fatigue, resulting in production of abnormal images. Therefore, an image forming apparatus without a discharger is suggested. However, since the entire surface of the photoconductor is not irradiated by a discharger to remove a residual potential therein prior to being charged, the surface of the photoconductor has uneven charge potential, still resulting in production of residual images.

Figure 7A:
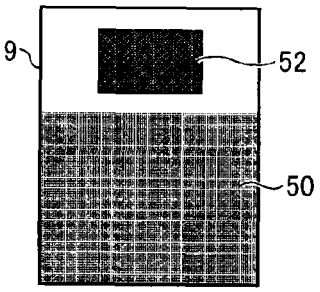
FIGS. 7A to 7C are charts for evaluating residual images, wherein 7A has no residual image, 7B has a positive residual image and 7C has a negative residual image.
Figure 7B:
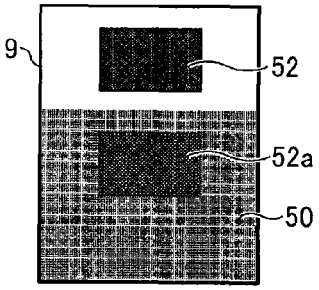

The residual image is, as FIG. 7B shows, a phenomenon in which a solid image pattern 52 formed before a halftone image 50 densely floats as a residual image 52*a* in the halftone image which should have been a uniform image.

Figure 7C:
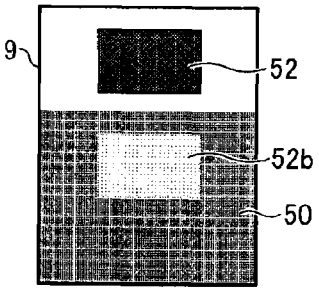

Such an abnormal image as a residual image is called a posi-residual image or a posi-ghost. Meanwhile, as FIG. 7C shows, a solid image pattern 52 formed before a halftone image 50 may thinly floats as a residual image 52*b* in the halftone image. Such an abnormal image is called a nega-residual image or a nega-ghost.

A full-color image forming apparatus needing to produce high-quality images has to suppress such deterioration of image quality due to the residual images. Particularly, the residual images frequently appear when solid images and halftone images are repeatedly produced.

Japanese published unexamined application No. JP-2002-107983-A and Japanese patents Nos. JP-3586011-B2 and JP-3416444-B2 (Japanese published unexamined applications Nos JP-H08-160677-A and JP-H09-288373-A, respectively) disclose image forming apparatuses suppressing the residual images, but they do not fully suppress them.

Japanese published unexamined application No. JP-2002-107983-A increases a volume resistivity of an intermediate layer and suppresses injection of (positive-hole) charge from an electroconductive substrate into the intermediate layer not to accumulate charges at an interface between a charge generation layer and the intermediate layer or in the charge generation layer. As a result, a hole generated in the charge generation layer is injected into a charge transport layer and accelerates transport therein. It is thought that an apparent sensitivity improves to suppress the residual images.

However, a residual charge actually accumulates and does not lead a radical solution.

Japanese patents Nos. JP-3586011-B2 and JP-3416444-B2 (Japanese published unexamined applications Nos. JP-H08-160677-A and JP-H09-288373-A, respectively) downsize the apparatus, and refers to cleaning during development without a waste toner or cleanerless system. A high-sensitive photoconductor specifying a half decay exposure is used to solve problems of defective charge due to untransferred toner and ghost images due to shading.

Japanese patent No. JP-5668733-B2 (Japanese published unexamined application No. JP-2013-037375-A) and Japanese published unexamined application No. JP-2014-197237-A discloses an electrophotographic photoconductor having less variation of sensitivity against variation of humidity in environment in which the photoconductor is used. Even when a specific crystalline oxy titanylphthalocyanine having high sensitivity is uses as a charge generation material, a potential variation in an exposure range relative to a halftone image of light attenuation curve is suppressed to provide stable images against variation of humidity in environment in which the photoconductor is used.

A water molecule present in the crystalline oxy titanylphthalocyanine as a charge generation material woks as a sensitizer for high sensitivity thereof in Japanese patent No. JP-5668733-B2 (Japanese published unexamined application No. JP-2013-037375-A) and Japanese published unexamined application No. JP-2014-197237-A.

Variation of the light attenuation due to the half decay exposure E1/2 and humidity is specified to solve a problem of difference of image density between images produced at normal humidity and images produced at low humidity.

Technical problems still remain in terms of solving residual image problems as well as complying recent demands for higher speed, downsizing and longer life.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

As FIG. 1 shows, an embodiment of the image forming apparatus of the present invention includes a photoconductor drum as an image bearer (photoconductor) 1, a charger 2, an irradiator 3, an image developer 4, a transferer 5, a cleaner 6 cleaning the surface of the photoconductor drum 1 after transferring a toner image, and a fixer 7. The cleaner 6 is located between the transferer 5 and the charger 2. The transferer 5 is unable to transfer a toner image on the photoconductor completely, and a toner remains thereon. The toner is removed by the cleaner 6 from the photoconductor. The cleaner 6 is a plate-shaped cleaning blade 6*a* formed of a rubber.

The cleaning blade 6*a* may be replaced with a brush such as fur brushes and mag fur brushes.

In addition, a recycler collecting the toner removed by the cleaner 6 to the image developer 4 and a controller may be included.

A discharger eliminating a charge of the photoconductor drum 1 after transferring a toner image is not located. The reason is mentioned later.

Figure 2:
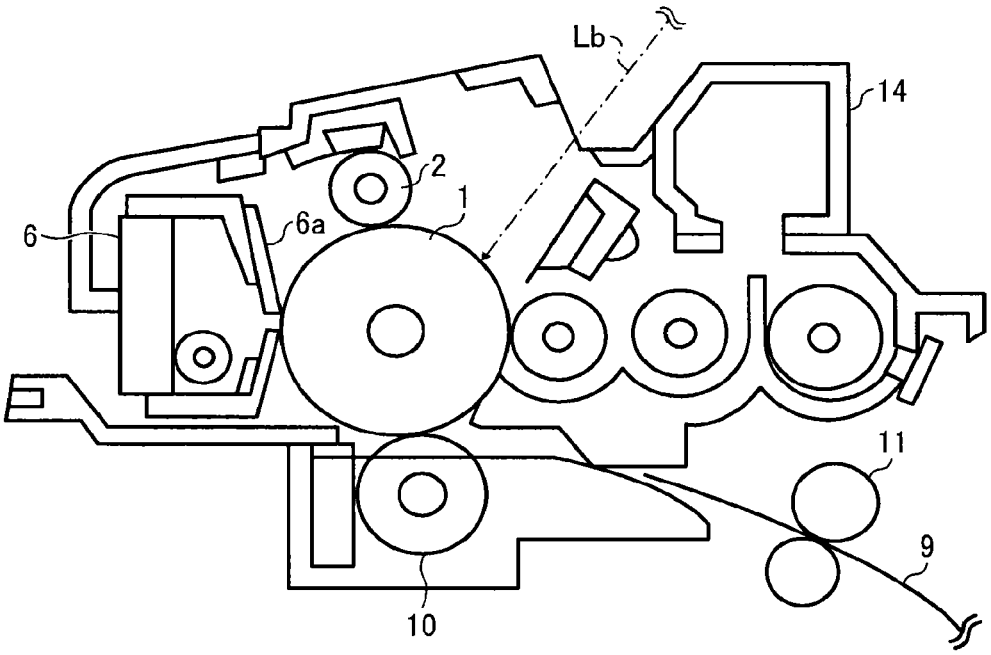
FIG. 2 is a schematic view illustrating a process cartridge detachable from the image forming apparatus.

FIG. 2 is a schematic view illustrating a process cartridge. The photoconductor drum 1 with at least one of the charger 2, the irradiator 3, the image developer 4, the transferer 5 and the cleaner 6 are contained in the process cartridge detachable from an image forming apparatus.

Each of the units may fixedly be installed in an image forming apparatus, but can easily be replaced in the form of detachable process cartridge. In FIG. 2, Lb represents a laser beam as exposure light irradiated from the irradiator 3 in FIG. 1.

The charger 2 uses a contact charging method contacting a charging roller as a charging member to the photoconductor. A corona discharge method represented by scorotron, a contact charging method contacting a charging brush to the photoconductor, a close location method having a gap not greater than 200 μm between the photoconductor 1 and the charger in an image forming area may be used.

A DC voltage may be overlapped with an AC voltage when a voltage is applied by the charger. This effectively suppresses uneven charge, but may cause insulation breakdown of the photoconductor. Therefore, when a DC voltage may be overlapped with an AC voltage, the photoconductor may be charged such that the insulation breakdown is not caused.

The photoconductor is charged by the charger, since the typical photoconductor of an image forming apparatus may cause background fouling due to the photoconductor, an electric field intensity applied to the photoconductor is set not greater than a predetermined value, e.g., not greater than 40 V/μm.

This is because background fouling depends on the electric field intensity, and increase of the electric field intensity increases probability of background fouling. However, when the electric field intensity applied to the photoconductor lowers, an electric field intensity between the surface of the photoconductor and an electroconductive substrate lowers.

Therefore, straightness of a photocarrier generated in the charge generation layer lowers and dispersion of a latent image due to Coulomb's repulsion enlarges, resulting in lowering of image resolution.

Since the photoconductor drum 1 can lower probability of background fouling, the electric field intensity does not need lowering. The photoconductor drum 1 is used at an electric field intensity of from 10 to 50 V/μm.

The electric field intensity is more preferably from 15 to 48 V/μm. When greater than 50 V/μm, background fouling becomes noticeable. When less than 15 V/μm, image resolution lowers, resulting in inability of maintaining image quality.

A light source of a semiconductor laser (LD) as an irradiating member is used for the irradiator 3. The irradiator 3 may use a light source having high brightness such as light emitting diode (LED) and electroluminescence (EL) as well as the semiconductor laser (LD). Besides, a light source including a multibeam writing head in which plural semiconductor laser (LD) elements are arranged in a main or sub-scanning direction of the photoconductor may be used.

In order to obtain light having a desired wave length range, filters such as sharp-cut filters, band pass filters, near-infrared cutting filters, dichroic filters, interference filters, color temperature converting filters and the like can be used.

Among these light sources, the semiconductor laser (LD) and the light emitting diode (LED) have high irradiation energy and a long wavelength of from 600 to 800 nm.

Light having the wavelength is highly sensitive to the charge generation material of the photoconductor of the present invention, and a semiconductor laser (LD) having a wavelength not less than 650 nm is preferably used.

Namely, the irradiator 3 irradiates the surface of the photoconductor 1 with a laser beam having a wavelength not less than 650 nm.

Figure 3:
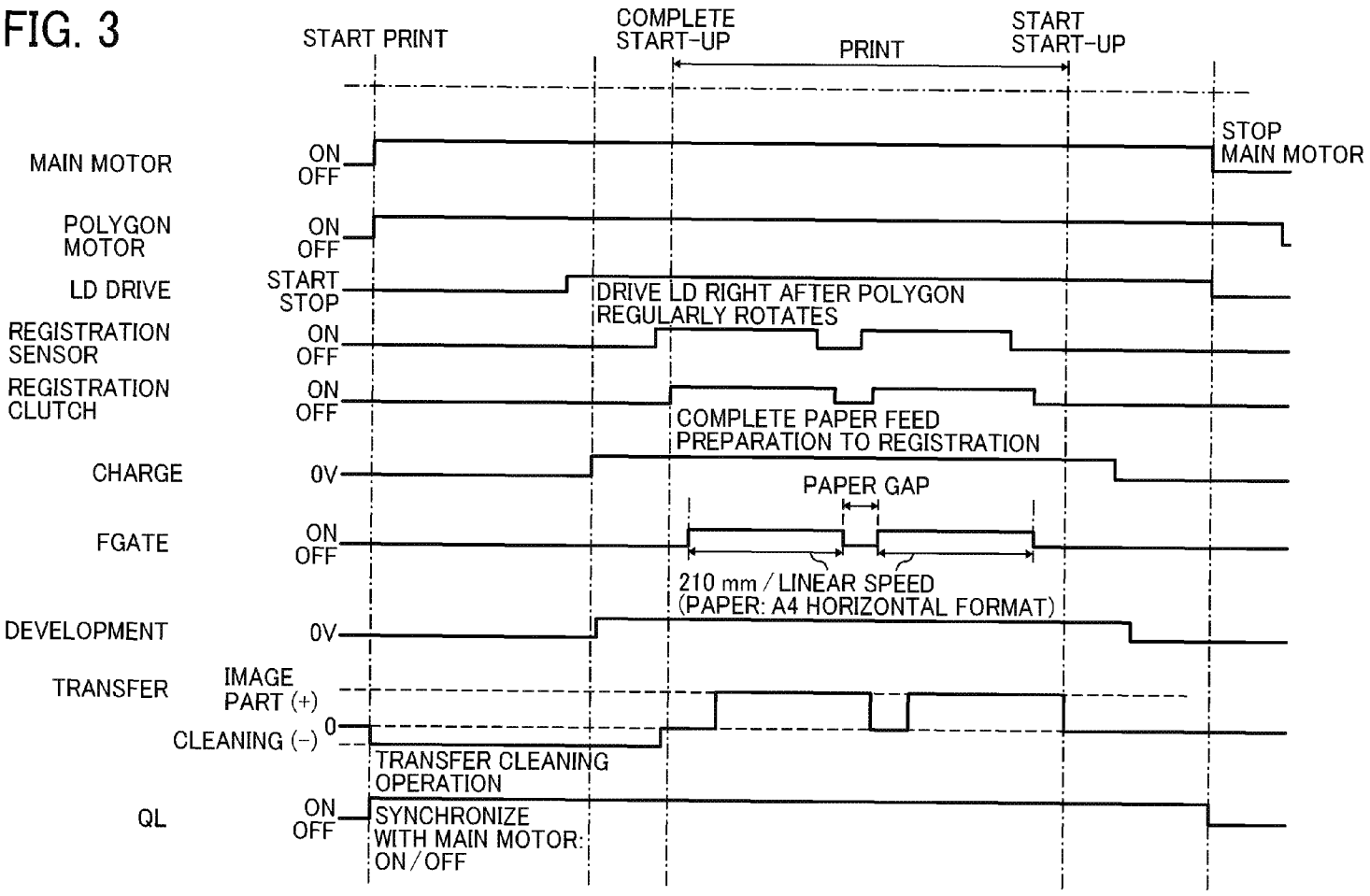
FIG. 3 is a timing chart of conventional image forming (printing) process.
Figure 4:
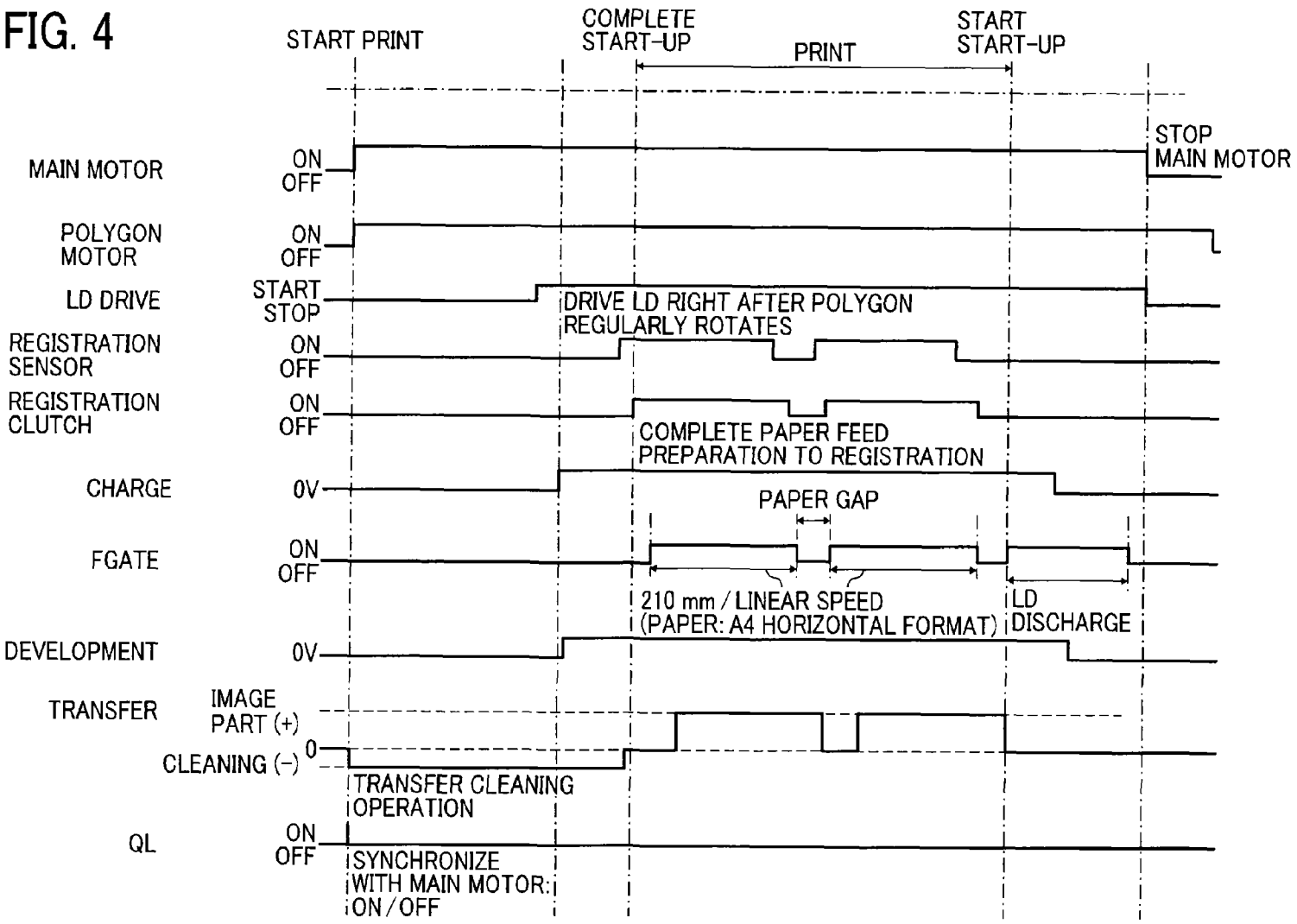
FIG. 4 is a timing chart of an embodiment of the image forming (printing) process of the present invention.

FIGS. 3 and 4 are timing charts of image forming process when continuously producing 20,000 images while horizontally passing A4-size sheets.

FIG. 3 is a conventional image forming timing chart, and QL as a discharger is synchronized with ON/OFF of a main motor. In addition to irradiation of a laser (LD) to form an electrostatic latent image, the photoconductor is irradiated for most of the image forming process time. Therefore, an optical fatigue lowers sensitivity of the photoconductor and accumulation of residual potential varies image quality.

FIG. 4 is an image forming timing chart of the present invention. As FIG. 4 shows, when printing is finished, a frame gate (FGATE) becomes ON in synchronization with a transfer bias being OFF. During this, the entire surface of the photoconductor is irradiated with a laser (LD) to eliminate a charge remaining in a photosensitive layer (LD discharge) and be ready for the following charge.

FGATE is a writing start signal for controlling writing of image data on a sub-scanning direction.

When the laser (LD) drives and the frame gate signal (FGATE) is on, the laser (LD) is irradiated. On the basis of start writing when the frame gate signal (FGATE) is on, e.g., from distances between irradiation and development, and irradiation and transfer, timing of various biases and timing of paper feed are controlled.

The image forming process shown in the timing chart in FIG. 4 includes only irradiating to form an electrostatic latent image and irradiating a laser with the irradiator 3 to discharge when finishing printing, and the photoconductor is exposed to light less.

Therefore, uneven image density caused by electrostatic deterioration of the photoconductor due to optical fatigue is suppressed. Exchange cycle of the photoconductor can be extended, running cost is low, low frequency of down time for exchanging components, and reliability is improved.

The discharge process by the irradiator 3 is performed after some numbers of one printing process (job) are finished. Namely, in FIG. 4, the discharge process is performed after two images are continuously produced, and not performed in every one printing (image forming) process as conventionally performed. Namely, a potential of the photoconductor is initialized for the following job.

The one printing process includes continuously forming some numbers of images, e.g., 2 pieces of images a user has specified.

FIG. 4 includes QL as a discharger in comparison with FIG. 3, which is not ON. Actually, a discharger is not located as FIG. 1.

The present invention also includes a case where a discharger is not ON in image forming process in an image forming apparatus including a discharger.

As FIG. 1 shows, the image developer 4 including a developing roller as a developing member is used to visualize an electrostatic latent image formed on the photoconductor 1. The image developer uses a two-component developing method including a dry toner. The image developer may use a one-component developing method and a wet developing method including a wet toner.

When the photoconductor is positively or negatively charged, and irradiated with imagewise light, a positive or a negative electrostatic latent image is formed on the surface of the photoconductor. When the positive or the negative electrostatic latent image is developed with a negative or positive-polarity toner, a positive image is obtained. When the positive or the negative electrostatic latent image is developed with a positive or negative-polarity toner, a negative image is obtained.

A toner 8 developed by the image developer 4 on the photoconductor is transferred by the transferer 5 onto a paper 9 as a recording medium. The transferer 5 includes a transfer roller 10 as a transfer member and a transfer bias power source. The transfer roller 10 is driven by a driver to rotate and a transfer bias from the transfer bias power source is applied to an axis of the transfer roller 10.

The paper 9 is fed from a pair of registration rollers 11 (in FIG. 2) at a predetermined timing to a nip between the transfer roller 10 and the photoconductor 1, and a toner image on the photoconductor 1 is transferred onto the paper 9.

The transfer roller 10 is formed of a rubber having low hardness to reduce transfer pressure against the paper 9, and may be formed of a foamed material to reduce transfer pressure.

In the transfer process, control methods of applying a transfer bias to form a transfer electric field include a constant current control method providing a constantly-current-controlled transfer bias to the transfer roller and a constant voltage control method providing a constantly-voltage-controlled transfer bias to the transfer roller.

The present invention used the constant current control method. The method has stable transferability because a transfer electric field formed in a transfer nip thereby is difficult to receive influence of resistance variation of the transfer members such as papers and the transfer roller.

Meanwhile, an effective transfer current influences upon a width of a paper in the longitudinal direction of the photoconductor. For example, a transfer bias when an A4 size paper is horizontally fed and a transfer bias when an A4 size paper is vertically fed are effectively different from each other. When vertically fed, the transfer roller and the photoconductor directly contact each other at a range a paper is not present, and a current flows much in the range, resulting in less effective transfer current.

Therefore, a current value of the transfer bias is controlled according to paper size and direction to equalize the effective transfer current according to the paper size.

In the embodiment of the image forming apparatus, when a small-size paper is fed, the current value of the transfer bias is changed such that currents flow more than when a larger size paper is fed. Thus, an effective transfer electric field capable of transferring a toner image onto a paper is obtained.

The current of the transfer bias changed higher also directly flows into a part of the photoconductor a paper does not contact to. An excessive charge is injected into a range of the photoconductor a paper does not contact to, resulting in variation of image density in the subsequent image forming process. Accordingly, the embodiment of the image forming apparatus forms an image at low irradiation energy.

In a conventional image forming apparatus, in order to suppress variation of image density in addition to assure image density, a potential variation width of a light attenuation curve of a high-sensitive photoconductor for higher speed and downsizing is decreased. Namely, a latent image is formed on the photoconductor with a strong exposure power. Therefore, a bright part potential is low, close to 0 V.

In a conventional image forming apparatus, a charge potential (dark part potential) is set large. This is because an electric field intensity between the surface of the photoconductor and the electroconductive substrate to increase straightness of a photocarrier (positive hole) generated in the charge generation layer and suppress dispersion of a latent image due to Coulomb's repulsion in the charge transport layer.

Latent image forming conditions in the conventional image forming apparatus have a large difference in potential between an exposure part bearing a toner image and negative charge potential (dark part potential) which is a non-image part. Therefore, equally to the difference in potential, a positive charge from the transfer roller is inclined to flow to a non-image part negatively charged.

Further, a small-size paper is fed, the current of the transfer bias excessively and directly flows into a part of the photoconductor a paper does not contact to, i.e., a dark potential of the photoconductor. A range the excessive positive charge is injected in is not negatively and uniformly charged sufficiently.

As a result, since the photoconductor is charged to have a potential lower than predetermined, a latent image profile of the last image history is reversed, resulting in production of a negative residual image at a part of the last image history and a part a paper does not contact to.

Namely, an image forming (bright) part of the last image history is charged to have a desired potential when charged for the following process, but a positive charge remains in the photosensitive layer as a residual charge at a non-image forming (dark) part of the last image history and a part a paper has not contacted to. The non-image forming (dark) part of the last image history and the part a paper has not contacted to are not charged to have a desired potential when charged for the following process. Even when irradiated to form a latent image, a negative residual image as a toner image thin in proportion as the bright part potential of the last image history is more negatively charged.

Figure 6:
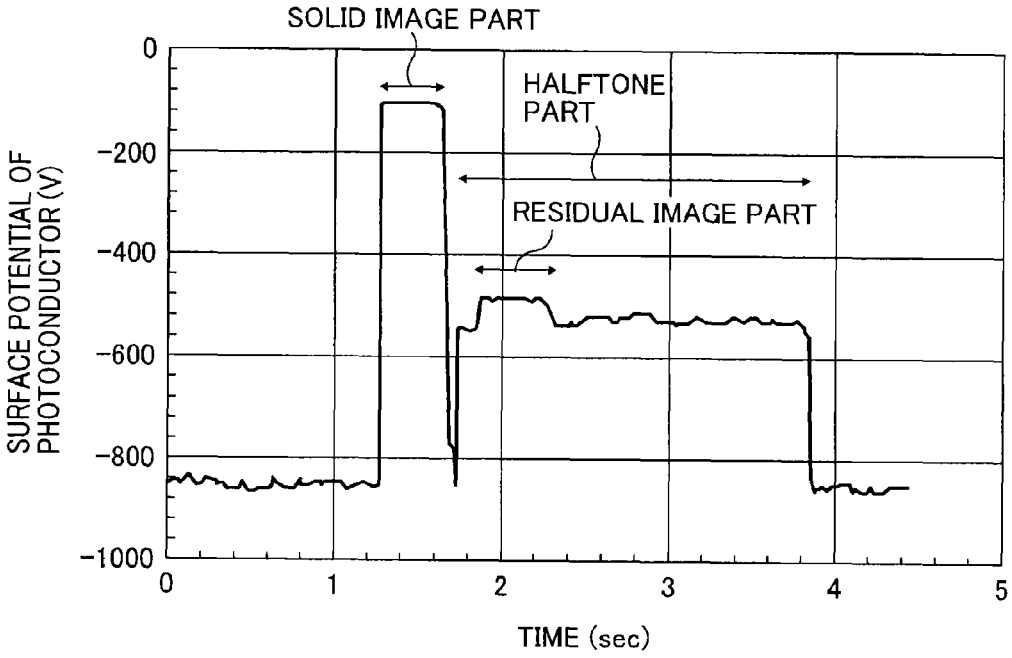
FIG. 6 is a diagram showing differences in surface potentials, respectively, for a solid image, a halftone image and a residual image.

FIG. 6 is a diagram showing differences of surface potentials of a solid image, a halftone image and a residual image.

The image forming apparatus of the embodiment forms a latent image at low irradiation energy. A difference between the irradiation part (bright part potential) and the negative charge potential of the non-image part (dark part potential) is small is proportion as a latent image is formed at low irradiation energy.

In FIG. 6, the non-image part has a negative charge potential (dark part potential: −900 V). The irradiation part (bright part potential) having a potential higher than that of the non-image part is a solid image part, and has a negative potential near 0 V. The image forming apparatus of the embodiment forms a potential of the solid image part at low irradiation energy to decrease the potential thereof and lessens a difference between the bright part potential and the dark part potential.

Therefore, since a positive charge from the transfer roller is not inclined to flow to a non-image part negatively charged, a negative residual image is not produced.

Further, the image forming apparatus of the embodiment decreases a transfer current value needed to transfer. Namely, a transfer electric field in a transfer process draws a toner adhering to the surface of the photoconductor to a paper with a positive charge having a reverse polarity while a latent image is formed.

However, since image forming apparatus of the embodiment forms a latent image at low irradiation energy, the bright part potential is more negative. Accordingly, the negatively-charged toner adhering to the bright part is weakened. Therefore, a transfer current needed to transfer the toner onto a paper is reduced.

The transfer bias current can suppress an excessive positive charge from flowing into the part of the photoconductor a paper does not contact to, i.e., the dark part, and a negative residual image is not produced.

An irradiation potential when forming a solid image equals to an irradiation potential when discharging with an LD in FIG. 4. In FIG. 4, charging and developing bias are stopped while discharging with an LD to completely discharge. Therefore, the photoconductor has a negative potential after discharged with an LD, and a negatively-charged toner on the developing roller is difficult to fly and adhere to the photoconductor.

The toner includes a binder resin, a colorant and a charge controlling agent as main components, and other additives when necessary.

Specific examples of the binder resin include polystyrene, styrene-acrylic acid ester copolymers, polyester resins, etc.

As the colorants used for the toner, known yellow, cyan, magenta and black colorants for toner can be used. The toner preferably includes the colorant in an amount of from 0.1 to 15 parts by weight per 100 parts by weight of the binder resin.

Specific examples of the charge controlling agent include a nigrosine-based dye, a chrome-containing complex, and a quaternary ammonium salt, etc. These are used depending on a polarity of the toner. The toner preferably includes the charge controlling agent in an amount of from 0.1 to 10 parts by weight per 100 parts by weight of the binder resin.

The toner advantageously includes a fluidity improver. Specific examples thereof include fine particles of metal oxides such as silica, titania and alumina; the fine particles the surfaces of which are treated with a silane coupling agent or a titanate coupling agent; and polymeric fine particles such as polystyrene, methyl polymethacrylate and polyvinylidene fluoride.

The fluidity improver preferably has a particle diameter of from 0.01 to 3 μm. The toner preferably includes the charge controlling agent in an amount of from 0.1 to 7.0 parts by weight per 100 parts by weight of the toner.

Methods of preparing a toner for two-component developer include known methods and combinations thereof. For example, kneading and pulverizing methods include mixing a binder resin, a colorant such as carbon black and an additive when necessary by dry processing; heating, melting and kneading the resultant mixture by an extruder, a two-roll mill or a three-roll mil; cooling the resultant kneaded mixture to be solidified; pulverizing the resultant solidified mixture by a pulverizer such as jet mills; and classifying the resultant pulverized mixture to prepare a toner.

A toner can directly be prepared by suspension polymerization methods or nonaqueous dispersion polymerization methods from monomers, a colorant and an additive. A carrier is typically formed of a core material alone or a coated core material.

The core material coated with a resin is preferably ferrite or magnetite. The core material preferably has a particle diameter of from 20 to 60 μm. Materials to be coated on the core material include vinylidenefluoride, tetrafluoroethylene, hexafluoropropylene, perfluoroalkylvinyl ether, fluorine-substituted vinyl ether and fluorine-substituted vinyl ketone. These materials may be coated on the core material by conventional spray coating methods or dip coating methods. One-component developing methods as well as the two-component developing methods can be used.

Figure 5A:
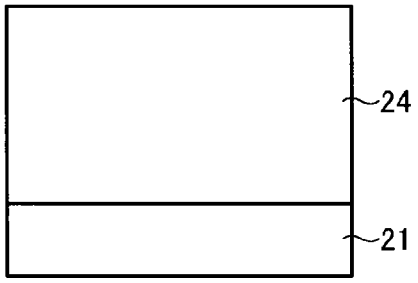
FIGS. 5A to 5D are cross-sectional views of layer structures of photoconductors.

The photoconductor drum 1 in FIG. 5A includes an electroconductive substrate 21; and a photosensitive layer 24 including at least a charge generation material and a polymeric charge transport material on the substrate 21.

Figure 5B:
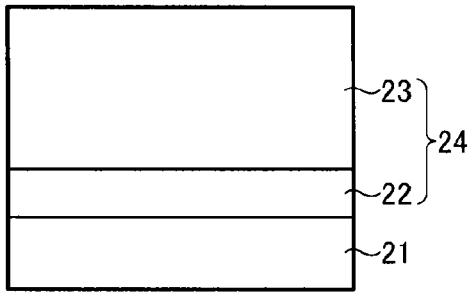

The photoconductor drum 1 in FIG. 5B includes an electroconductive substrate 21; a charge generation layer 22; and a photosensitive layer 24 including at least a charge transport layer 23 on the substrate 21.

Figure 5C:
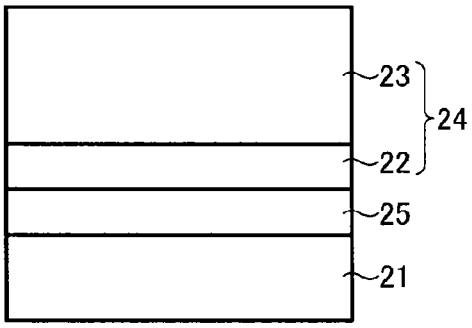
Figure 5D:
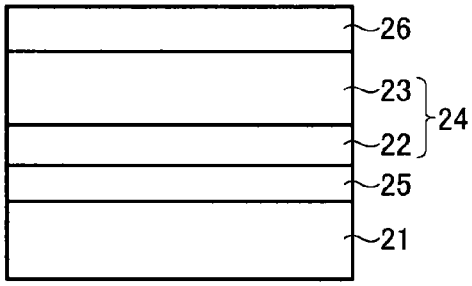

The photoconductor drum 1 in FIG. 5C includes an electroconductive substrate 21; an undercoat layer 25 on the substrate 21; and a photosensitive layer 24 on the undercoat layer 25.

The photoconductor drum 1 in FIG. 5C includes an electroconductive substrate 21; an undercoat layer 25 on the substrate 21; a photosensitive layer 24 on the undercoat layer 25; and a protection layer 26 on the photosensitive layer 24.

Namely, the photoconductor drum 1 may have random combinations of the above layers if it only includes a photosensitive layer including at least a charge generation material and a polymeric charge transport material on the substrate 21.

As the electroconductive substrate 21, an electroconductive substrate having a volume resistance of not greater than $10\times10^{10}$ Ω·cm such as plastic or paper having a film-like form or cylindrical form covered with a metal such as aluminum, nickel, chrome, nichrome, copper, gold, silver, and platinum, or a metal oxide such as tin oxide and indium oxide by depositing or sputtering can be used. Alternatively, a seamless endless belt formed with the above metals by electroforming methods or a board formed of aluminum, an aluminum alloy, nickel, and a stainless metal can be used. In addition, a tube which is manufactured from the board by a crafting technique such as extruding and extracting and surface-treatment such as cutting, super finishing, and grinding can be used.

As a substrate for endless-belt-shaped photoconductor, the film subjected to conducting treatment or the seamless endless belt formed with the above metals by electroforming methods can be used.

In addition, an electroconductive substrate formed by coating a liquid in which electroconductive powder is dispersed in a suitable binder resin on a substrate made from plastic can also be used as the electroconductive substrate 21. Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of binder resin used simultaneously include, but are not limited to, thermoplastic resins, thermosetting resins or photocurable resins such as polystyrene resins, copolymers of styrene and acrylonitrile, copolymers of styrene and butadiene, copolymers of styrene and maleic anhydrate, polyesters resins, polyvinyl chloride resins, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenolic resins, and alkyd resins. Such an electroconductive layer can be formed by dispersing the electroconductive powder and the binder resins mentioned above in a suitable solvent, for example, tetrahydrofuran, dichloromethane, methyl ethyl ketone and toluene, and applying the resultant to an electroconductive substrate.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and TEFLON (registered trademark), with an electroconductive material, can also be preferably used as the substrate 21.

An image bearer used in the embodiment of the image forming apparatus may have a multilayered or a single-layered structure, and preferably has a multilayered structure.

The charge generation layer includes an asymmetric diazo pigment and a metal-free phthalocyanine pigment. The metal-free phthalocyanine pigment preferably includes τ-type metal-free phthalocyanine and/or X-type metal-free phthalocyanine.

The asymmetric diazo pigment having a large ionization potential of 5.82 and the metal-free phthalocyanine pigment having a small ionization potential of from 5.15 to 5.2 are mixed to decrease a barrier against a charge between the charge generation layer and the charge transport layer. Accordingly, a charge smoothly passes in the photosensitive layer without being trapped to maintain charge stability. A charge transport material used in a typical photoconductor has an ionization potential of from 5.3 to 5.6 eV.

The charge generation layer includes an asymmetric diazo pigment having an ionization potential larger than that of a charge transport materials as a charge generation material. This effectively suppresses a positive charge injected in a transfer process transferring a toner onto a recording medium such as papers from the photoconductor from flowing into the charge generation layer from the charge transport layer. Consequently, a latent image potential (potential of image forming parts) is difficult to change to positive.

Thus, the photoconductor can comparatively maintain negative potential. An electric field intensity at the latent image forming part is not weakened and a charge smoothly transports in the photosensitive layer. Images without residual images caused by charge trap due to the last image history can be produced.

The bright part of the negatively-charged photoconductor is irradiated with a low irradiation energy to form a latent image.

The latent image potential (bright part potential) equal to image part is negative, lower than 0 V. Even when the bright part potential changes to be positive by influence of positive charge from the transferer, the final bright part potential after transfer can keep negative.

In the present invention, both the image forming process and the configuration of the photoconductor suppress production of residual images due to the latent image potential (residual potential).

Ionization potential relations between the charge generation material and the charge transport material have relation to background fouling. The background fouling is a phenomenon where innumerable black point images are printed on a blank area.

Even if the background fouling is not a problem initially, the influence thereof increases while images are repeatedly, resulting in a large factor to decide a life of the photoconductor.

Mechanism of the background fouling is thought as follows. When a photoconductor is charged, a positive charge having a polarity reverse to that of a negative charge induced at a side of the electroconductive substrate locally leaks. The positive charge is injected into the undercoat layer and further into the photosensitive layer to eliminate a charge on the surface of the photoconductor. The part the positive charge leaks from is easy to develop.

The abrasion of the photoconductor while repeatedly used causes increase of the electric field (V/μm), and a positive charge induced at a side of the electroconductive substrate is injected into the photosensitive layer, resulting in noticeable increase of background fouling.

In the present invention, the charge generation material includes a metal-free phthalocyanine pigment having a small ionization potential of from 5.15 to 5.2. This heightens a barrier against for a positive charge to transport from the charge generation layer to the charge transport layer because of an ionization potential relation therebetween.

Therefore, even when the electric field is so strong that the undercoat layer is unable to block the positive charge induced at a side of the electroconductive substrate, transport of the positive charge from the charge generation layer to the charge transport layer is blocked to suppress background fouling caused by elimination of the surface potential of the photoconductor.

This is because the charge generation layer includes an asymmetric diazo pigment capable of suppressing injection of a positive charge from a transferer and a metal-free phthalocyanine pigment capable of suppressing a positive charge having a polarity reverse to that of a charge polarity induced at a side of the electroconductive substrate from injecting into the photosensitive layer. This prevents background fouling and prolongs a life of the photoconductor.

The ionization potentials of a charge generation layer and a charge transport layer formed on PET films are measured by an atmospheric photoemission spectrometer AC-2 from RIKEN KEIKI Co., Ltd.

As the τ-type metal-free phthalocyanine, a metal-free phthalocyanine pigment having a Cu-Kα X-ray (wavelength of 1.541 Å) diffraction spectrum such that main peaks are observed at a Bragg (2θ) angle of 7.6°, 9.2°, 16.8°, 17.4°, 20.4°, 20.9°, 21.7° and 27.6° (±0.2° respectively) is preferably used, which can be obtained by methods disclosed in Japanese published unexamined applications Nos. JP-S58-182639-A and JP-S60-19154-A.

As the X-type metal-free phthalocyanine, a metal-free phthalocyanine pigment having a Cu-Kα X-ray (wavelength of 1.541 Å) diffraction spectrum such that main peaks are observed at a Bragg (2θ) angle of 7.5°, 9.1°, 16.7°, 17.3°, 22.3° and 23.8° (±0.2° respectively) is preferably used, which can be obtained by methods disclosed in US patents Nos. U.S. Pat. No. 3,357,989 and U.S. Pat. No. 359,416, and Japanese published unexamined applications Nos. JP-S549-4338-A and JP-S60-243089-A.

These generate and separate a latent image charge when irradiated, and may be used with a binder resin in a layer including a charge generation material as a main component.

In the present invention, an asymmetric disazo pigment having the following formula (1) is sued as a charge generation material.

$$Cp1-N=N-A-N=N-Cp2 \quad (1)$$

wherein A represents a divalent residual group of a compound having carbon atoms each of which bonded to a nitrogen atom of azo bond (, from which the carbon atoms have been debonded). Cp1 and Cp2 represent coupler residual groups having different structures each other.

These asymmetric disazo pigments can be obtained by sequentially reacting a correspondent diazonium salt compound with a coupler correspondent to Cp1 or Cp2 through two steps, or a coupler obtained by the first coupling reaction with Cp1 or Cp2.

Examples of A, Cp1 and Cp2 of the asymmetric disazo pigments are shown in Tables 1 to 10.

TABLE 1

| [Main Skeleton A] | |
|---|---|
| NO. | |
| A-1 | 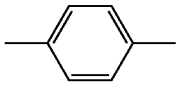 |
| A-2 | 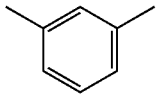 |

TABLE 1-continued

| [Main Skeleton A] | |
|---|---|
| NO. | |
| A-3 | 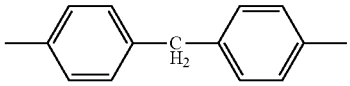 |
| A-4 | 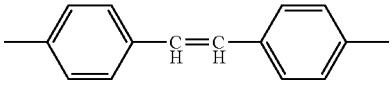 |
| A-5 | 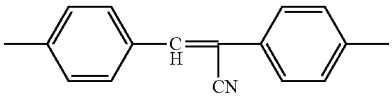 |
| A-6 | 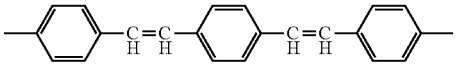 |
| A-7 | 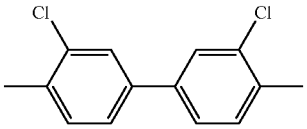 |
| A-8 | 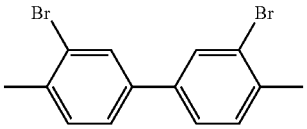 |
| A-9 | 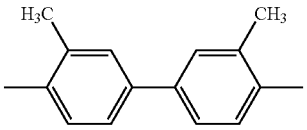 |
| A-10 | 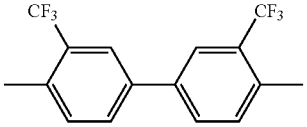 |
| A-11 | 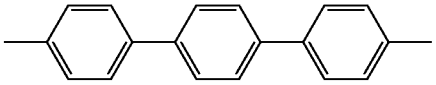 |
| A-12 | 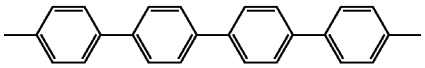 |

TABLE 2

| [Main Skeleton A] | |
|---|---|
| NO. | |
| A-13 | 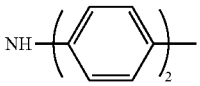 |

TABLE 2-continued
| [Main Skeleton A] | |
|---|---|
| NO. | |
| A-14 | 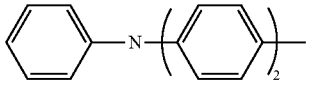 |
| A-15 | 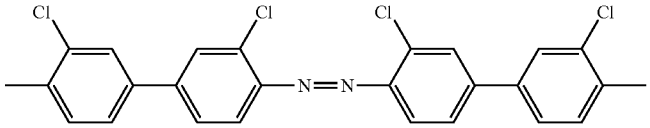 |
| A-16 | 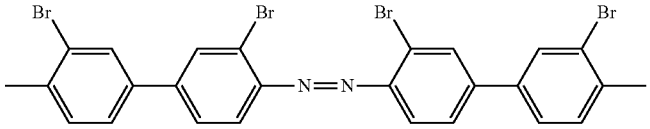 |
| A-17 | 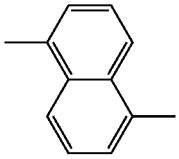 |
| A-18 | 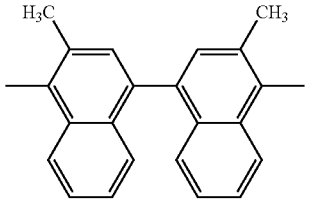 |
| A-19 | 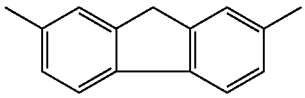 |
| A-20 | 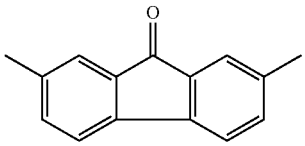 |
| A-21 | 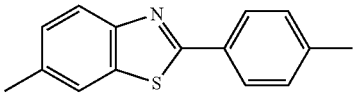 |
| A-22 | 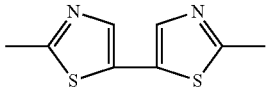 |
| A-23 | 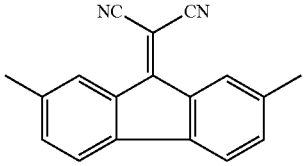 |

TABLE 3

| [Main Skeleton A] | |
|---|---|
| NO. | |
| A-24 | 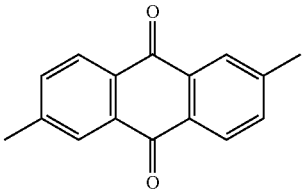 |
| A-25 | 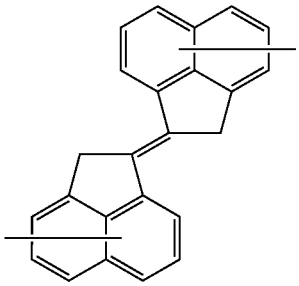 |
| A-26 | 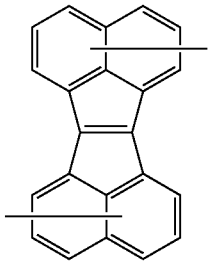 |
| A-27 | 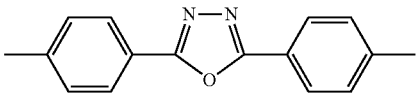 |
| A-28 | 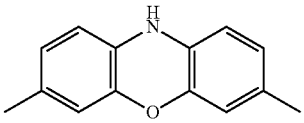 |
| A-29 | 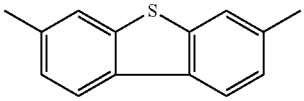 |
| A-30 | 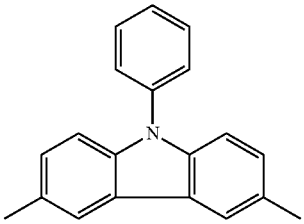 |

TABLE 4

Examples of Cp1 and Cp2 (C1)

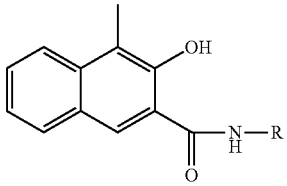

| No. | R |
|---|---|
| 1 | Phenyl |
| 2 | 2-chlorphenyl |
| 3 | 3-chlorphenyl |
| 4 | 4-chlorphenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-plazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

TABLE 5

Examples of Cp1 and Cp2 (C2)

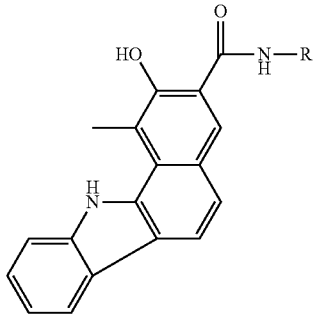

| No. | R |
|---|---|
| 1 | Phenyl |
| 2 | 2-chlorphenyl |
| 3 | 3-chlorphenyl |
| 4 | 4-chlorphenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |

TABLE 5-continued

Examples of Cp1 and Cp2 (C2)

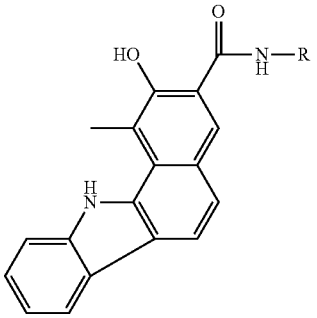

| No. | R |
|---|---|
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-plazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

TABLE 6

Examples of Cp1 and Cp2 (C3)

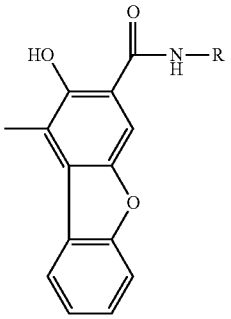

| No. | R |
|---|---|
| 1 | Phenyl |
| 2 | 2-chlorphenyl |
| 3 | 3-chlorphenyl |
| 4 | 4-chlorphenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |

TABLE 6-continued

Examples of Cp1 and Cp2 (C3)

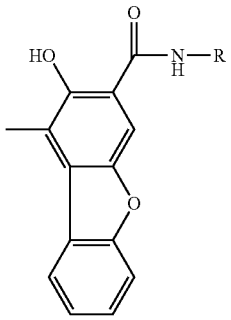

| No. | R |
|---|---|
| 19 | 4-cyanophenyl |
| 20 | 1-naphthyl |
| 21 | 2-anthraquinolyl |
| 22 | 3,5-bistrifluoromethylphenyl |
| 23 | 4-plazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

TABLE 7

Examples of Cp1 and Cp2 (C4)

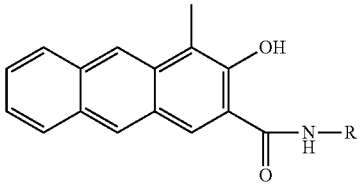

| No. | R |
|---|---|
| 1 | Phenyl |
| 2 | 2-chlorphenyl |
| 3 | 3-chlorphenyl |
| 4 | 4-chlorphenyl |
| 5 | 2-nitrophenyl |
| 6 | 3-nitrophenyl |
| 7 | 4-nitrophenyl |
| 8 | 2-trifluoromethyl |
| 9 | 3-trifluoromethyl |
| 10 | 4-trifluoromethyl |
| 11 | 2-methylphenyl |
| 12 | 3-methylphenyl |
| 13 | 4-methylphenyl |
| 14 | 2-methoxyphenyl |
| 15 | 3-methoxyphenyl |
| 16 | 4-methoxyphenyl |
| 17 | 2-cyanophenyl |
| 18 | 3-cyanophenyl |
| 19 | 4-cyanophenyl |
| 20 | 1-naphthyl |
| 21 | 2-anthraquinolyl |
| 22 | 3,5-bistrifluoromethylphenyl |
| 23 | 4-plazolyl |
| 24 | 2-thiazolyl |
| 25 | 4-carboxyl-2-thiazolyl |
| 26 | 2-pyridyl |
| 27 | 2-pyrimidinyl |
| 28 | 2-carbazolyl |
| 29 | 2-quinolyl |

TABLE 8

Examples of Cp1 and Cp2 (C5)

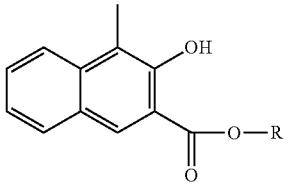

| No. | R |
|---|---|
| 1 | Methyl |
| 2 | Ethyl |
| 3 | Propyl |
| 4 | Isopropyl |
| 5 | Butyl |
| 6 | Isobutyl |
| 7 | sec-butyl |
| 8 | tert-butyl |
| 9 | Pentyl |
| 10 | Isoamyl |
| 11 | Hexyl |
| 12 | Heptyl |
| 13 | Octyl |
| 14 | Capryl |
| 15 | Nonyl |
| 16 | Decyl |
| 17 | Undecyl |
| 18 | Lauryl |
| 19 | Tridecyl |
| 20 | Pentadecyl; |

TABLE 9

Examples of Cp1 and Cp2 (C6)

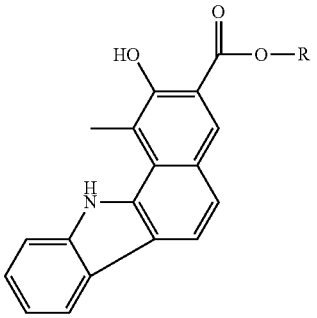

| No. | R |
|---|---|
| 1 | Methyl |
| 2 | Ethyl |
| 3 | Propyl |
| 4 | Isopropyl |
| 5 | Butyl |
| 6 | Isobutyl |
| 7 | sec-butyl |
| 8 | tert-butyl |
| 9 | Pentyl |
| 10 | Isoamyl |
| 11 | Hexyl |
| 12 | Heptyl |
| 13 | Octyl |
| 14 | Capryl |
| 15 | Nonyl |
| 16 | Decyl |
| 17 | Undecyl |
| 18 | Lauryl |
| 19 | Tridecyl |
| 20 | Pentadecyl; |

TABLE 10

Examples of Cp1 and Cp2 (C7-1, C7-2 and C8)

(C7-1)

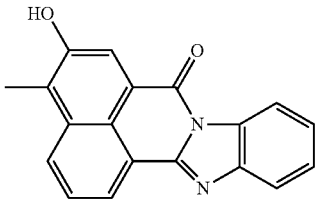

(C7-2)

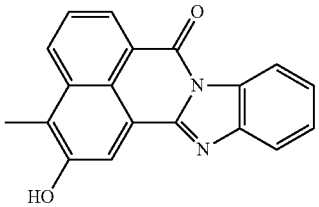

(C8-1)

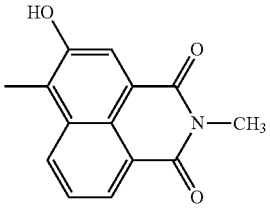

Specific examples of binder resins used in the charge generation layer include, but are not limited to, polyamide, polyurethane, epoxy resins, polyketone, polycarbonate, polyarylate, silicone resins, acrylic resins, polyvinyl butyral resins, polyvinyl formal resins, polyvinyl ketone, polystyrene, poly-N-vinylcarbazole, polyacrylamide, polyvinylbenzal, polyester, phenoxy resins, vinylchloride-vinylacetate copolymers, polyvinylacetate, polyphenyleneoxide, polyvinylpyridine, cellulose resins, casein, polyvinylalcohol and polyvinylpyrrolidone.

The charge generation layer preferably includes the binder resin in an amount of from 0 to 500 parts by weight, and more preferably from 10 to 300 parts by weight per 100 parts by weight of the charge generation material.

The polymeric charge transport: material can be used as the binder resin in the charge generation layer.

Further, the charge generation layer may include a low-molecular-weight charge transport material when necessary. The low-molecular-weight charge transport material includes a positive hole transport material and an electron transport material.

Specific examples of the electron transport material include known electron accepting materials such as chloranil, bromanil, tetraeyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-41-1-indeno[1, 2-b] thiophene-4-one, 1,3,7-trinitrobenzothiophene-5,5-dioxide, 3,5-dimethyl-3',5'-ditertiarybutyl-4,4'-diphenoquinone and benzoquinone derivatives. These electron transport materials can be used alone or in combination.

Specific examples of the positive hole transport material include, but are not limited to, electron donating materials such as oxazole derivatives, oxadiazole derivatives, imidazole derivatives, monoarylamines derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, thiazole derivatives, triazole derivatives, phenazine derivatives, acridine derivatives, benzofuran derivatives, benzimidazole derivatives and thiophene derivatives. These positive hole transport materials can be used alone or in combination.

Suitable methods for forming the charge generation layer are broadly classified into thin film forming methods in a vacuum and casting methods.

Specific examples of the former thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods for forming the charge generation layer typically include the following steps:

(1) preparing a coating liquid by mixing one or more inorganic or organic charge generation materials mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a charge generation layer coating liquid;

(2) coating the charge generation layer coating liquid, which is diluted if necessary, on a substrate by a method such as dip coating, spray coating and bead coating; and (3) drying the coated liquid to form a charge generation layer.

The charge generation layer preferably has a thickness of from about 0.01 to about 5 μam, and more preferably from about 0.1 to about 2 μm.

Next, the charge transport layer is explained.

The binder resins for use in the charge transport layer include polycarbonate resins such as bisphenol A type and bisphenol Z type, polyester resins, methacrylic resins, acrylic resins, vinyl chloride, vinylacetate, polystyrene resins, phenol resins, epoxy resins, polyurethane, polyvinylidene chloride. Alkyd resins, silicone resins, polyvinyl carbazole, polyvinylbutyral, polyvinylformal, polyacrylate, polyacrylic amide and phenoxy resins, etc.

These binder resins can be used alone or in combination. The charge transport layer preferably includes the binder resin of from 0 to 30 parts by weight per 100 parts by weight of the charge transport material.

The charge transport layer can include a low-molecular-weight charge transport material which is the same as those included in the charge generation layer. The charge transport layer preferably includes the low-molecular-weight charge transport material of from 0 to 30 parts by weight per 100 parts by weight of the binder resin.

The charge transport layer may include a low-molecular-weight compound such as an antioxidant, a plasticizer, and a UV absorber in an amount of from 0 to 150 parts by weight, and more preferably from 0 to 30 parts by weight per 100 parts by weight of the binder resin. The charge transport layer may include a leveling agent in an amount of from 0 to 5 parts by weight per 100 parts by weight of the binder resin.

Further, the charge transport layer preferably includes a filler when being an outermost surface layer.

An Organic photoconductor typically has a large disadvantage of low durability. Durability is broadly classified into durability against mechanical load such as abrasion and damages on the surface of the photoconductor and durability of electrostatic properties against accumulation of residual potential and deterioration of chargeability while repeatedly used. Particularly, a life of the photoconductor depends on the mechanical durability. Besides, the surface layer of the photoconductor has disadvantages of adherence of a low-resistivity material caused by ozone generated when charged with corona, filming and adherence of toner due to defective cleaning of the toner. The photoconductor is required to have durability, particularly mechanical durability and releasability of materials adhering to the surface of the photoconductor, which the life of which depends on.

The outermost surface layer of the photoconductor effectively includes the filler to meet these requirements. The filler include organic and inorganic fillers. Specific examples of the organic fillers include powders of fluorocarbon resins such as polytetrafluoroethylene, silicone resin powders and a-carbon powders. Specific examples of inorganic fillers include metal oxides such as silica, tin oxide, zinc oxide, titanium oxide, indium oxide, antimony oxide, bismuth oxide, tin oxide doped with antimony, indium oxide doped with tin; metal fluorides such as tin fluoride, potassium fluoride and aluminum fluoride; potassium titanate; boron nitride; etc. These can be used alone or in combination. Besides these materials, known materials can be used.

Further, the filler is preferably subjected to surface treatment with at least one inorganic or organic material to improve dispersibility and surfaceness thereof.

Lowering of dispersibility of the filler not only causes increase of residual potential, but also lowering transparency of the film, defects thereof, and further lowering of abrasion resistance. Therefore, higher durability and higher image quality may be impaired.

As the surface treatment agents, known surface treatment agents can be used, but surface treatment agents capable of maintaining insulativity of the filler such as titanate coupling agents, aluminum coupling agents, zircoaluminate coupling agents, higher fatty acids, combinations of these agents with a silane coupling agent, and $Al_2O_3$, $TiO_2$, $ZrO_2$, silicones, aluminum stearate or their mixtures are preferably used in terms of dispersibility of the filler.

Silane coupling agent decreases resistivity, but combination with the above surface treatment agents may suppress the influence.

The surface of the filler is preferably treated with the surface treatment agent in an amount of from 3% to 30% by weight, and more preferably from 5% to 20% by weight, depending on the average primary particle diameter of the filler, though.

The filler is dispersed with ketone solvents such as methyl ethyl ketone, acetone, methyl isobutyl ketone and cyclohexanone; ether solvents such as dioxane, tetrahydrofuran and ethylcellosolve, aromatic solvents such as toluene and xylene; halogen solvents such as chlorobenzene and dichlormethane; and ester solvents such as ethylacetate and butylacetate. Known dispersers such as ball mills, sand mils and vibration mills can be used.

When the charge transport layer is an outermost surface layer, the charge transport layer preferably includes a filler in an amount of from 0% to 40% by weight, and more preferably from 0.1% to 30% by weight based on total weight of the solid contents. When less than 0.1% by weight, the abrasion resistance is insufficient.

When greater than 40% by weight, the image quality deteriorates because the layer is opacified and the image resolution lowers, and the sensitivity lowers and the image density lowers. The filler is preferably pulverized and dispersed so as to have a volume-average particle diameter of from 0.05 to 1.0 μm, and more preferably from 0.05 to 0.8 μm.

When less than 0.05 μm, the filler is difficult to uniformly disperse. When larger than 1.0 μm, the filler projects on the surface of the photoconductor to damage a cleaning blade, resulting in defective cleaning.

The charge transport layer is coated by dip coating methods, spray coating methods, ring coat methods, roll coater methods, gravure coating methods, nozzle coating methods, screen printing methods, etc. When the coating liquid dissolves the lower layer, the spray coating methods or the ring coat methods which are easy to control a contact time between the lower layer and the coating liquid and an amount of a solvent in the coating liquid contacting the lower layer are preferably used.

The charge transport layer preferably has a thickness of from 5 to 100 μm, and more preferably from 10 to 40 μm.

An undercoat layer may be formed between the electroconductive substrate and the charge generation layer. The undercoat layer is formed for the purpose of improving adherence of the photosensitive layer to the substrate, preventing moire, improving coating capability of the above layer, and decreasing the residual potential. The undercoat layer includes a resin as a main constituent. Since a photosensitive layer is typically formed on the undercoat layer by coating a liquid including an organic solvent, the resin in the undercoat layer preferably has good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and hardening resins capable of forming a three-dimensional network such as polyurethane resins, melamine resins, alkyd-melamine resins, epoxy resins, etc.

The undercoat layer may include a fine powder of metal oxides such as titanium oxide, silica, alumina, zirconium oxide, tin oxide and indium oxide; metal sulfides or metal nitrides. The undercoat layer 25 can be formed by using a proper solvent and a conventional coating method.

Further, a metal oxide layer formed by, e.g., a sol-gel method using a silane coupling agent, titanium coupling agent or a chromium coupling agent, a layer of aluminum oxide which is formed by an anodic oxidation method and a layer of an organic compound such as polyparaxylylene (parylene) or an inorganic compound such as SiO, SnO2, TiO2, ITO or CeO2 which is formed by a vacuum evaporation method is can be used as the undercoat layer. The undercoat layer preferably has a thickness of from 0.5 to 15 μm.

A protection layer may be formed on the photosensitive layer of the photoconductor to protect the photosensitive layer. Suitable materials for use in the protection layer include ABS resins, ACS resins, olefin-vinyl monomer copolymers, chlorinated polyethers, aryl resins, phenolic resins, polyacetal, polyamides, polyester resins, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, polyester, etc.

The protection layer may include a filler used in the charge transport layer to improve the abrasion resistance. The protection layer is formed by a conventional coating method. The protection layer preferably has a thickness of from 0.5 to 10 μm. In addition, a protection layer formed by a vacuum thin film forming method using known materials such as a-C and a-SiC can be used. Further, the protection layer may include the charge transport material, an antioxidant, a plasticizer, a lubricant, a UV absorber and a leveling agent when necessary.

In the present invention, an antioxidant may be included to improve environmental resistance, particularly to prevent deterioration of sensitivity and increase of residual potential. The antioxidant may be included in any layers including an organic material, and preferably included in a layer including a charge transport material. Known antioxidants can be used in the present invention.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Mw represents a polystyrene-converted weight-average molecular weight measured by a gel permeation chromatography (GPC) method.

Image Bearer Preparation Example 1

An undercoat coating liquid, a charge generation coating liquid and charge transport coating liquid, which have the following compositions, were coated and dried in this order on an aluminum cylinder having a diameter of 30 mm to form an undercoat layer, a charge generation layer and a charge transport layer having thickness of 4.5 μm, 0.2 μm and 40 μm, respectively thereon. Thus, an image bearer 1 was prepared.

[Undercoat Layer Coating Liquid]

| | |
|---|---|
| Alkyd resin<br>(BECKOSOL 1307-60-EL from Dainippon Ink And Chemicals, Inc.) | 6 |
| Melamine resin<br>(Super Beckamine G821-60 from Dainippon Ink And Chemicals, Inc.) | 4 |
| Titanium oxide<br>(CR-EL from Ishihara Sangyo Kaisha Ltd.) | 40 |
| Methyl ethyl ketone | 200 |

[Charge Generation Layer Coating Liquid]

| | |
|---|---|
| Bisazo pigment having the following formula (P-1) | 24 |

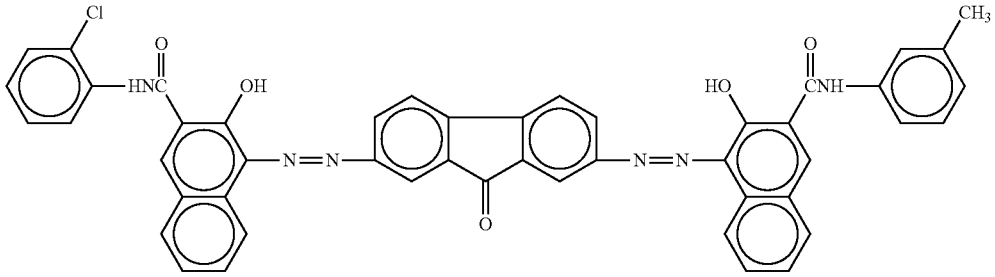

(P-1)

| | |
|---|---|
| τ-type metal-free phthalocyanine | 12 |
| Polyvinylbutyral (S-LEC BL-1 from Sekisui Chemical Co., Ltd.) | 12 |
| Cyclohexanone | 1680 |
| Methyl ethyl ketone | 390 |

[Charge Transport Layer Coating Liquid]

| | |
|---|---|
| Bisphenol Z-type polycarbonate (Mw: 112,000) (Panlite TS-2050 from Teijin Chemicals Ltd.) | 10 |
| Charge transport material having the following formula (D-1), and an ionization potential of 5.4 | 7 |

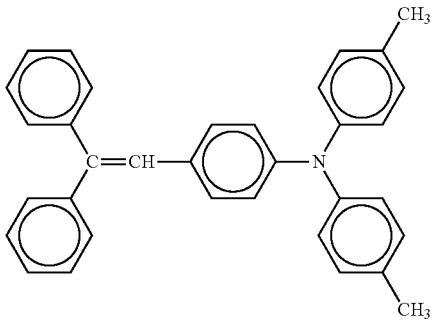

(D-1)

| | |
|---|---|
| Silicone oil (KF50-100CS from Shin-Etsu Chemical Industry Co., Ltd.) | 0.002 |
| Tetrahydrofuran | 70 |

Image Bearer Preparation Example 2

The procedure for preparation of the image bearer 1 in image Bearer Preparation Example 1 was repeated except for replacing the charge generation layer coating liquid with a coating liquid having the following composition to prepare an image bearer 2

| | |
|---|---|
| Bisazo pigment having the following formula (P-1) | 24 |
| τ-type metal-free phthalocyanine | 12 |
| Polyvinylbutyral (S-LEC BL-1 from Sekisui Chemical Co., Ltd.) | 24 |
| Cyclohexanone | 1680 |
| Methyl ethyl ketone | 390 |

Image Bearer Preparation Example 3

The procedure for preparation of the image bearer 1 in Image Bearer Preparation Example 1 was repeated except for replacing the charge generation layer coating liquid with a coating liquid having the following composition to prepare an image hearer 3.

| | |
|---|---|
| Bisazo pigment having the following formula (P-1) | 24 |
| X-type metal-free phthalocyanine | 12 |
| Polyvinylbutyral (S-LEC BL-1 from Sekisui Chemical Co., Ltd.) | 24 |
| Cyclohexanone | 1680 |
| Methyl ethyl ketone | 390 |

Image Bearer Preparation Example 4

The procedure for preparation of the image bearer 1 in Image Bearer Preparation Example 1 was repeated except for changing the thickness of the charge generation layer into 0.2 μm to prepare an image bearer 4.

Image Bearer Preparation Example 5

The procedure for preparation of the image bearer 1 in Image Bearer Preparation Example 1 was repeated except for replacing the charge generation layer coating liquid with a coating liquid having the following composition to prepare an image bearer 5.

| | |
|---|---|
| Bisazo pigment having the following formula (P-1) | 12 |
| τ-type metal-free phthalocyanine | 24 |
| Polyvinylbutyral (S-LEC BL-1 from Sekisui Chemical Co., Ltd.) | 24 |
| Cyclohexanone | 1680 |
| Methyl ethyl ketone | 390 |

Image Bearer Preparation Example 6

The procedure for preparation of the image bearer 1 in Image Bearer Preparation Example 1 was repeated except for replacing the charge generation layer coating liquid with a coating liquid having the following composition to prepare an image bearer 6.

| | |
|---|---|
| Bisazo pigment having the following formula (P-1) | 12 |
| X-type metal-free phthalocyanine | 24 |
| Polyvinylbutyral (S-LEC BL-1 from Sekisui Chemical Co., Ltd.) | 36 |
| Cyclohexanone | 1680 |
| Methyl ethyl ketone | 390 |

Image Bearer Preparation Example 7

The procedure for preparation of the image bearer 1 in Image Bearer Preparation Example 1 was repeated except for replacing the charge generation layer coating liquid with a coating liquid having the following composition to prepare an image bearer 7.

| | |
|---|---|
| Bisazo pigment having the following formula (P-1) | 12 |
| τ-type metal-free phthalocyanine | 12 |
| Polyvinylbutyral (S-LEC BL-1 from Sekisui Chemical Co., Ltd.) | 24 |
| Cyclohexanone | 1680 |
| Methyl ethyl ketone | 390 |

Image Bearer Preparation Example 8

The procedure for preparation of the image bearer 1 in Image Bearer Preparation Example 1 was repeated except for replacing the charge generation layer coating liquid with a coating liquid having the following composition to prepare an image bearer 8.

| | |
|---|---|
| Bisazo pigment having the following formula (P-1) | 12 |
| τ-type metal-free phthalocyanine | 12 |
| Polyvinylbutyral (S-LEC BL-1 from Sekisui Chemical Co., Ltd.) | 16 |
| Cyclohexanone | 1680 |
| Methyl ethyl ketone | 390 |

Image Bearer Preparation Example 9

The procedure for preparation of the image bearer 1 in Image Bearer Preparation Example 1 was repeated except for replacing the charge generation layer coating liquid with a coating liquid having the following composition to prepare an image bearer 9.

| | |
|---|---|
| Bisazo pigment having the following formula (P-1) | 24 |
| Polyvinylbutyral (S-LEC BL-1 from Sekisui Chemical Co., Ltd.) | 12 |
| Cyclohexanone | 1680 |
| Methyl ethyl ketone | 390 |

Image Bearer Preparation Example 10

The procedure for preparation of the image bearer 1 in Image Bearer Preparation Example 1 was repeated except for replacing the charge generation layer coating liquid with a coating liquid having the following composition to prepare an image bearer 10.

| | |
|---|---|
| τ-type metal-free phthalocyanine | 24 |
| Polyvinylbutyral (S-LEC BL-1 from Sekisui Chemical Co., Ltd.) | 12 |
| Cyclohexanone | 1680 |
| Methyl ethyl ketone | 390 |

Image Bearer Preparation Example 11

The procedure for preparation of the image bearer 1 in Image Bearer Preparation Example 1 was repeated except for replacing the charge generation layer coating liquid with a coating liquid having the following composition to prepare an image bearer 11.

| | |
|---|---|
| Bisazo pigment having the following formula (P-1) | 12 |
| Titanylphthalocyanine pigment (crystal having main peaks at a Bragg (2θ) angle of 9.6° ± 0.2°, 24.0° ± 0.2° and 27.2° ± 0.2)° | 12 |
| Polyvinylbutyral (S-LEC BL-1 from Sekisui Chemical Co., Ltd.) | 12 |
| Cyclohexanone | 1680 |
| Methyl ethyl ketone | 390 |

Image Bearer Preparation Example 12

The procedure for preparation of the image bearer 1 in Image Bearer Preparation Example 1 was repeated except for replacing the charge generation layer coating liquid with a coating liquid having the following composition to prepare an image bearer 12.

| | |
|---|---|
| X-type metal-free phthalocyanine | 12 |
| Titanylphthalocyanine pigment (crystal having main peaks at a Bragg (2θ) angle of 9.6° ± 0.2°, 24.0° ± 0.2° and 27.2° ± 0.2)° | 24 |
| Polyvinylbutyral (S-LEC BL-1 from Sekisui Chemical Co., Ltd.) | 12 |
| Cyclohexanone | 1680 |
| Methyl ethyl ketone | 390 |

Image Bearer Preparation Example 13

The procedure for preparation of the image bearer 1 in Image Bearer Preparation Example 1 was repeated except for replacing the charge generation layer coating liquid with a coating liquid having the following composition to prepare an image bearer 13.

| | |
|---|---|
| Titanylphthalocyanine pigment (crystal having main peaks at a Bragg (2θ) angle of 9.6° ± 0.2°, 24.0° ± 0.2° and 27.2° ± 0.2)° | 24 |
| Polyvinylbutyral (S-LEC BL-1 from Sekisui Chemical Co., Ltd.) | 16 |
| Methyl ethyl ketone | 480 |

The constitution and of the thickness of the charge generation layer of each of the image bearers are shown in Table 11.

The thicknesses of the film before and after the charge generation layer was formed on the undercoat layer were measured by eddy-current film thickness meter (FISCHER SCOPE from Fischer Instruments K. K.), and a difference thereof was defined as a thickness of the charge generation layer.

TABLE 11

| Image bearer | Charge generation material I | Charge generation material II | Mixing ratio I/II | Mixing ratio CGM/binder resin | Thickness (μm) |
|---|---|---|---|---|---|
| 1 | Asymmetric disazo pigment | τ-type metal-free phthalocyanine | 2/1 | 2/1 | 0.2 |
| 2 | Asymmetric disazo pigment | τ-type metal-free phthalocyanine | 2/1 | 3/2 | 0.2 |
| 3 | Asymmetric disazo pigment | X-type metal-free phthalocyanine | 2/1 | 2/1 | 0.2 |
| 4 | Asymmetric disazo pigment | τ-type metal-free phthalocyanine | 2/1 | 2/1 | 0.15 |
| 5 | Asymmetric disazo pigment | τ-type metal-free phthalocyanine | 1/2 | 2/1 | 0.2 |
| 6 | Asymmetric disazo pigment | X-type metal-free phthalocyanine | 2/1 | 1/1 | 0.2 |
| 7 | Asymmetric disazo pigment | τ-type metal-free phthalocyanine | 1/1 | 1/1 | 0.2 |
| 8 | Asymmetric disazo pigment | τ-type metal-free phthalocyanine | 1/1 | 3/2 | 0.2 |
| 9 | Asymmetric disazo pigment | — | — | 2/1 | 0.2 |
| 10 | — | τ-type metal-free phthalocyanine | — | 2/1 | 0.2 |
| 11 | Asymmetric disazo pigment | Titanylphthalocyanine | 2/1 | 2/1 | 0.2 |
| 12 | Titanylphthalocyanine | X-type metal-free phthalocyanine | 2/1 | 2/1 | 0.2 |
| 13 | Titanylphthalocyanine | — | — | 3/2 | 0.15 |

*CGM: Charge Generation Material

Examples 1 to 8 and Comparative Examples 1 to 5

Each of the image bearers was set in an experimental sensitivity simulator including a charger, an LD and a surface potential meter, capable of changing a rotational number of the drum and light quantity to measure a half decay exposure (μJ/cm$^2$).

The experimental sensitivity simulator includes an irradiator including the charger and the LD, and the surface potential meter between the charger and the irradiator. Each device located around the photoconductor is freely movable in the circumferential, radial and longitudinal directions to measure the properties of photoconductors having various sizes.

The experimental sensitivity simulator was made by the applicant and disclosed in Japanese published unexamined application No. JP-2000-275872-A.

According to an irradiation power needed, a light attenuation filter or the number thereof is changed, and the surface potential of the photoconductor is measured while changing an LD drive current of the irradiator to obtain data of the irradiation energy and the surface potential.

The half decay exposure means an exposure of Vd/2 when Vd is a surface potential of the photoconductor. In each of Examples and Comparative Examples, the image bearer was charged to −900 V, and irradiated by the irradiator to obtain an exposure needed to decay to −450 V.

The half decay exposure is a value showing a sensitivity of the image bearer. The smaller the half decay exposure, the higher the sensitivity.

[Running Test]

Each of the image bearers 1 to 13 was installed in the process cartridge in FIG. 2, and the process cartridge was installed in an image forming apparatus imagio MP3353 without a discharge lamp from Ricoh Company, Ltd.

The irradiator included an LD having a wavelength of 780 nm and had an irradiation energy of 0.42 μJ/cm$^2$.

A bright part potential (solid image part potential) and (irradiation energy)/(half decay exposure) when a latent image was formed at an irradiation energy of 0.42 μJ/cm$^2$ are shown in Table 12

TABLE 12

| | Image bearer | Half decay exposure (μJ/cm$^2$) | Bright part potential (V) | (Irradiation energy)/(Half decay exposure) |
|---|---|---|---|---|
| Example 1 | 1 | 0.21 | −250 | 2.0 |
| Example 2 | 2 | 0.22 | −260 | 1.9 |
| Example 3 | 3 | 0.20 | −255 | 2.1 |
| Example 4 | 4 | 0.25 | −280 | 1.7 |
| Example 5 | 5 | 0.28 | −290 | 1.5 |
| Example 6 | 6 | 0.24 | −280 | 1.8 |
| Example 7 | 7 | 0.30 | −300 | 1.4 |
| Example 8 | 8 | 0.27 | −285 | 1.6 |
| Comparative Example 1 | 10 | 0.40 | −430 | 1.1 |
| Comparative Example 2 | 11 | 0.09 | −55 | 4.7 |
| Comparative Example 3 | 12 | 0.12 | −70 | 3.5 |
| Comparative Example 4 | 13 | 0.08 | −50 | 5.3 |

A contact charging roller was used as a charging member in the image forming apparatus. A DC voltage was applied to the charging member, a developing bias was controlled such that the photoconductor had a linear speed of 150 mm/sec and a charge potential of −900V, and the solid image part density was not less than 1.4. The transferer was applied with a current of 15 μA. The photoconductor was applied with an electric field intensity of 22.5 V/μm.

A developer for developing electrostatic latent images, including a pulverization toner having a volume-average particle diameter about 9.5 μm (from Ricoh Company, Ltd.) in an amount of 5% by weight and a carrier coated with a silicone resin having a volume-average particle diameter about 50 μm was used.

In an environment of normal temperature and normal humidity (23° C. and 55% RH), an A4 original having a pixel density of 600 dpi×600 dpi and an image areal ratio of 5% was used. Five images were continuously produced on MyPaper from NBS Ricoh Co., Ltd., and totally 50,000 images were produced to evaluate variation of inner potential (dark part potential: VD and bright part potential: VL), residual image, background fouling, abrasion resistance, and overall image quality. The results are shown in Table 13.

[Evaluation of Residual Image Due to Potential]

The potential of the surface of the photoconductor was measured while a chart in FIG. 7A is produced. When a potential of halftone part is V1 and a potential of residual image part is V2, a residual image potential (Va)=V2−V1.

When Va is a positive value, the residual image is a positive residual image. When a negative value, the residual image is a negative residual image. The larger the value, the more noticeable the residual image in halftone images.

[Measurement of Transfer Ratio]

An A4 plain paper on which plural rectangular black solid images each having a size of 1 cm×3 cm were located was vertically passed through the apparatus, and the apparatus was stopped when a toner was transferred onto a paper. A weight (M0) of the toner on the photoconductor before transferred and a weight (M1) of the toner thereon untransferred after development were measured to determine a transfer ratio based on the following formula.

$$\text{Transfer ratio } (\%)=(M0-M1)/M0\times 100$$

[Measurement of Abrasion Amount]

The thicknesses of the layer before and after the running test were measured by eddy-current film thickness meter (FISCHER SCOPE from Fischer Instruments K. K.), and a difference thereof was defined as an abrasion amount.

[Evaluations of ΔVD and ΔVL]

As for the bright part potential, the developing parts was equipped with a potential meter probe was installed, and the surface potential of the image bearer transported to the developing part after charged and irradiated was measured.

$\Delta VD$=(Initial dark part potential: −900 V)−(Dark part potential after 50,000 images were produced)

$\Delta VL$=(Initial bright part potential: −900 V)−(Dark bright part potential after 50,000 images were produced)

[Image Evaluation]

Halftone, image resolution, abnormal images were integrally evaluated.

The results are shown in Table 13.

TABLE 13

| | | Initial | | | |
|---|---|---|---|---|---|
| | Image bearer | Residual image part potential | Residual image rank | Background fouling rank | Transfer ratio (%) |
| Example 1 | 1 | 0 | 5 | 5 | 92.0 |
| Example 2 | 2 | 0 | 5 | 5 | 91.3 |
| Example 3 | 3 | 0 | 5 | 5 | 91.4 |
| Example 4 | 4 | 0 | 5 | 5 | 91.2 |
| Example 5 | 5 | 0 | 5 | 5 | 90.3 |
| Example 6 | 6 | 0 | 5 | 5 | 90.5 |
| Example 7 | 7 | 0 | 5 | 5 | 91.2 |
| Example 8 | 8 | 0 | 5 | 5 | 90.5 |
| Comparative Example 1 | 10 | −15 | 4 | 5 | 91.8 |
| Comparative Example 2 | 11 | −24 | 5 | 3.5 | 88.4 |
| Comparative Example 3 | 12 | −27 | 3 | 5 | 89.8 |
| Comparative Example 4 | 13 | −30 | 2 | 5 | 88.9 |

| | | After 50,000 images | | | | | |
|---|---|---|---|---|---|---|---|
| | Image bearer | Residual image part potential | ΔVD(V) | ΔVL(V) | Residual image rank | Background fouling rank | Abrasion amount (μm) |
| Example 1 | 1 | 0 | 10 | 15 | 5 | 5 | 4.1 |
| Example 2 | 2 | 0 | 12 | 15 | 5 | 5 | 3.8 |
| Example 3 | 3 | 0 | 10 | 12 | 5 | 5 | 3.9 |
| Example 4 | 4 | 0 | 11 | 20 | 5 | 5 | 4.3 |
| Example 5 | 5 | 0 | 14 | 14 | 5 | 5 | 4.4 |
| Example 6 | 6 | 0 | 14 | 15 | 5 | 5 | 4.0 |
| Example 7 | 7 | 0 | 12 | 20 | 5 | 5 | 4.0 |
| Example 8 | 8 | 0 | 12 | 15 | 5 | 5 | 4.5 |
| Comparative Example 1 | 10 | −20 | 21 | 25 | 3 | 5 | 5.5 |
| Comparative Example 2 | 11 | −33 | 27 | 31 | 5 | 3 | 5.8 |
| Comparative Example 3 | 12 | −35 | 25 | 33 | 3 | 5 | 6.1 |
| Comparative Example 4 | 13 | −38 | 40 | 35 | 2.5 | 5 | 6.2 |

TABLE 13-continued

| | Image bearer | Image evaluation |
|---|---|---|
| Example 1 | 1 | Good |
| Example 2 | 2 | Good |
| Example 3 | 3 | Good |
| Example 4 | 4 | Good |
| Example 5 | 5 | Good |
| Example 6 | 6 | Good |
| Example 7 | 7 | Good |
| Example 8 | 8 | Good |
| Comparative Example 1 | 10 | Noticeable uneven image density |
| Comparative Example 2 | 11 | Image density varies for each printed image |
| Comparative Example 3 | 12 | Uneven halftone image |
| Comparative Example 4 | 13 | Image density varies for each printed image |

Negative residual images appeared on halftone images in Comparative Examples 1 to 4. As for Comparative Example 1, using only τ-type metal-free phthalocyanine pigment as a charge generation material is thought to cause the negative residual image. A positive charge injected in the transfer process remains in the photosensitive layer, which is thought to cause the negative residual image.

As for Comparative Examples 2 to 4, each using high-sensitive titanylphthalocyanine as a charge generation material is thought to cause the negative residual image. A positive charge injected in the transfer process remains in the photosensitive layer, which is thought to cause the negative residual image.

In Comparative Examples 2 to 4 each using high-sensitive titanylphthalocyanine as a charge generation material, the bright part potential largely varied, i.e., image quality was unstable. When plural pieces of the same image were printed, image density varied for each printed image.

In Comparative Examples 2 to 4 each forming a latent image with a strong irradiation energy to a half decay exposure, the bright part potentials were near 0 (not greater than −100 V). Therefore, electrostatic adherence of a negatively-charged toner adhering to a part where an electrostatic latent image is formed was strong, and the transfer ratios are thought to lower.

In Examples 1 to 8 each forming a latent image with a low irradiation energy, the irradiated part potential closes to negative. Therefore, electrostatic adherence between the photoconductor and a toner is low, and the transfer ratio to a paper improves sufficient toner density on a paper is maintained.

The photoconductors of the present invention including an asymmetric disazo pigment and a metal-free phthalocyanine pigment in the charge generation layer had good results.

Examples 9 to 12 and Comparative Examples 5 to 12

The procedure for evaluation in Example 1 was repeated except that the LD had a wavelength of 655 nm while the irradiation energy was changed to have a desired bright part potential, and the image bearers shown in Tables 14 and 15 were used.

A bright part potential (solid image part potentials) and (irradiation energy)/(half decay exposure) are shown in Table 14, and evaluation results are shown in Table 15.

TABLE 14

| | Image bearer | Irradiation energy (μJ/cm$^2$) | Bright part potential (V) | (Irradiation energy)/(Half decay exposure) |
|---|---|---|---|---|
| Example 9 | 1 | 0.50 | −200 | 2.3 |
| Example 10 | 1 | 0.32 | −350 | 1.5 |
| Example 11 | 3 | 0.48 | −200 | 2.4 |
| Example 12 | 3 | 0.31 | −350 | 1.6 |
| Comparative Example 5 | 1 | 0.75 | −150 | 3.6 |
| Comparative Example 6 | 3 | 0.74 | −150 | 3.7 |
| Comparative Example 7 | 9 | 0.34 | −150 | 2.4 |
| Comparative Example 8 | 9 | 0.30 | −200 | 2.1 |
| Comparative Example 9 | 9 | 0.27 | −350 | 1.9 |
| Comparative Example 10 | 13 | 0.22 | −150 | 2.8 |
| Comparative Example 11 | 13 | 0.18 | −200 | 2.3 |
| Comparative Example 12 | 13 | 0.11 | −350 | 1.8 |

TABLE 15

| | | | | Initial | | |
|---|---|---|---|---|---|---|
| | Image bearer | Irradiation energy (μJ/cm$^2$) | VL (V) | Residual image part potential | Residual image rank | Transfer ratio (%) |
| Example 9 | 1 | 0.50 | −200 | 0 | 5 | 91.6 |
| Example 10 | 1 | 0.32 | −350 | 0 | 5 | 92.1 |
| Example 11 | 3 | 0.48 | −200 | 0 | 5 | 91.1 |
| Example 12 | 3 | 0.31 | −350 | 0 | 5 | 91.3 |
| Comparative Example 5 | 1 | 0.75 | −150 | 20 | 3 | 88.3 |
| Comparative Example 6 | 3 | 0.74 | −150 | 22 | 3 | 87.6 |

TABLE 15-continued

| | | | | | | |
|---|---|---|---|---|---|---|
| Comparative Example 7 | 9 | 0.34 | −150 | 28 | 2.5 | 87.7 |
| Comparative Example 8 | 9 | 0.30 | −200 | 24 | 3 | 88.1 |
| Comparative Example 9 | 9 | 0.27 | −350 | 20 | 3.5 | 92.2 |
| Comparative Example 10 | 13 | 0.22 | −150 | −30 | 2 | 87.1 |
| Comparative Example 11 | 13 | 0.18 | −200 | −25 | 3 | 88.3 |
| Comparative Example 12 | 13 | 0.11 | −350 | −20 | 3.5 | 88.5 |

| | Image bearer | After 50,000 images Image evaluation |
|---|---|---|
| Example 9 | 1 | Good |
| Example 10 | 1 | Good |
| Example 11 | 3 | Good |
| Example 12 | 3 | Good |
| Comparative Example 5 | 1 | Deterioration of image resolution, uneven image density |
| Comparative Example 6 | 3 | Deterioration of image resolution, uneven image density |
| Comparative Example 7 | 9 | Background fouling, Deterioration of image resolution, uneven image density |
| Comparative Example 8 | 9 | Background fouling |
| Comparative Example 9 | 9 | Background fouling |
| Comparative Example 10 | 13 | Deterioration of image resolution, uneven image density |
| Comparative Example 11 | 13 | Large image density variation between pages |
| Comparative Example 12 | 13 | Large image density variation between pages |

In Comparative Examples 5, 6, 7 and 10 each having a large difference between the dark part potential (−900 V) and the bright part potential, an excessive transfer current flowed in a non-image part. The transfer ration lowered because sufficient transfer current did not flowed in an image part, resulting in deterioration of image resolution of the image part. An area having a large image area had uneven image density due to insufficient transferability.

In Comparative Examples 7, 8 and 9 each using only an asymmetric disazo pigment as a charge generation material, the electric field intensity increased due to abrasion of the photoconductor from ionization potential relation with a charge transport material. A positive charge injected from the electroconductive substrate passed the charge generation layer and reached the charge transport layer to eliminate a surface charge, resulting in background fouling.

Comparative Examples 11 and 12 each used high-sensitive titanylphthalocyanine as a charge generation material. Therefore, when a latent image was formed at lower irradiation energy, the bright part potential more largely varied, resulting in unstable image quality, i.e., large image density variation between pages.

Examples 13 to 15 and Comparative Examples 13 to 15

Next, the LD was changed to have a wavelength of 780 nm, the charge potential was adjusted to be −1000, −800 and −700V to measure the half decay exposures, and the irradiation energy was changed to have desired bright part potential. The developing bias was controlled such that the solid image had an image density not less than 1.4 to perform running test.

In an environment of normal temperature and normal humidity (23° C. and 55% RH), an A4 original having a pixel density of 600 dpi×600 dpi and an image areal ratio of 5% was used. Five hundred images were produced on MyPaper from NBS Ricoh Co., Ltd. to visually observe the image density variation. The results are shown in Table 16.

TABLE 16

| | Image bearer | Charge potential (V) | Half decay exposure ($\mu J/cm^2$) | Irradiation energy ($\mu J/cm^2$) | Bright part potential (V) |
|---|---|---|---|---|---|
| Example 13 | 1 | −1000 | 0.28 | 0.48 | −250 |
| Example 14 | 1 | −800 | 0.20 | 0.43 | −200 |
| Example 15 | 1 | −700 | 0.17 | 0.43 | −150 |
| Comparative Example 13 | 11 | −1000 | 0.10 | 0.17 | −250 |
| Comparative Example 14 | 11 | −800 | 0.072 | 0.15 | −200 |
| Comparative | 11 | −700 | 0.060 | 0.15 | −150 |

TABLE 16-continued

| Example 15 | | | | | |
|---|---|---|---|---|---|
| | Image bearer | (Irradiation energy)/(Half decay exposure) | Electric field intensity (V/μm) | Residual image rank | Image evaluation |
| Example 13 | 1 | 1.7 | 25 | 5 | Good |
| Example 14 | 1 | 1.5 | 20 | 5 | Good |
| Example 15 | 1 | 2.5 | 17.5 | 5 | Good |
| Comparative Example 13 | 11 | 1.7 | 25 | 3.5 | Large image density variation between pages |
| Comparative Example 14 | 11 | 2.1 | 20 | 3 | Large image density variation between pages |
| Comparative Example 15 | 11 | 2.5 | 17.5 | 2 | Solid image density increased |

In each of Examples 13 and 14, the half decay exposure was from 0.12 to 0.28 μJ/cm$^2$, and even when the irradiation energy was changed, the image density did not vary between pages.

Each of Comparative Examples 13 and 14 is extremely a high-sensitive photoconductor having a low half decay exposure. When such a high-sensitive photoconductor continuously produces images, the bright part potential tends to vary as time passes, resulting in variation of solid image density. In each of Comparative Examples 13 and 14 having high bright part potentials, when the bright part potential varied, the image density largely varied.

Although Comparative Example 15 is a photoconductor having a low bright part potential, i.e., −150 V, the photoconductor is thought to have further increased sensitivity while 500 images were produced, and the image density gradually increased.

When the photoconductor of the present invention including an asymmetric disazo pigment and a metal-free phthalocyanine pigment in the charge generation layer was used, and an electrostatic latent image was formed at an irradiation energy larger than a half decay exposure of the photoconductor and not greater than 2.5 times of the half decay exposure (Example 15 in Table 16), the image quality was good.

The photoconductor 1 had a half decay exposure of from 0.17 to 0.3 μJ/cm$^2$ as is evident from Example 7 in Table 12 and Example 15 in Table 16.

A difference of the bright part potential when an electrostatic latent image is formed on the photoconductor 1 and the bright part potential before the surface of the photoconductor 1 after transfer is preferably from 50 to 350 V.

An image bearer including a photosensitive layer including an asymmetric disazo pigment and a metal-free phthalocyanine pigment and having high charge stability without a charge stagnation at the interface was used, and a latent image was formed at a low irradiation energy, i.e., not higher than 2.5 times of the half decay exposure. Therefore, the bright part potential varies less, injection of a positive charge in transfer process is prevented or suppressed, and a residual image due to latent image (residual) potential was not produced.

In addition, having a wide spectral sensitivity from a visible to an infrared range and high charge stability, the image bearer is capable of printing at high speed and saving space. Since a discharger is not needed, the apparatus can be downsized and the cost can be reduced. Optical deterioration (deterioration of sensitivity) of the image bearer due to excessive light energy is suppressed to more increase potential stability.

Further, an image part on which an electrostatic latent image is formed by an irradiator changes the charge potential to be positive with a transfer current after development and transfer processes to prevent production of positive residual images.

At the same time, a difference of potential contrast between an image part and a non-image part becomes small to suppress a transfer current excessively flown in the non-image part and prevent production of positive residual images.

The image forming apparatus of the present invention is capable of printing at high speed, saving space, being downsized, and precisely suppressing production of abnormal images due to latent image (residual) potential.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image bearer;

a charging member to charge the surface of the image bearer;

an irradiating member to irradiate the surface of the image bearer to form an electrostatic latent image on the surface of the image bearer;

a developing member to develop the electrostatic latent image with a toner to form a visible toner image on the surface of the image bearer; and a transferring member to transfer the toner image onto a transfer material, wherein the image bearer includes a charge generation layer including an asymmetrical disazo pigment and a metal-free phthalocyanine pigment, and a charge transport layer, wherein the irradiating member forms the electrostatic latent image at an irradiation energy greater than a half decay exposure of the image bearer and not greater than 2.5 times of the half decay exposure, and wherein the image bearer is not discharged every image forming process, and wherein the irradiating member irradiates the image bearer in synchronization with a transfer bias being turned off to discharge the surface of the image bearer after at least two image forming processes are completed.

2. The image forming apparatus of claim 1, wherein the irradiating member irradiates the surface of the image bearer with a laser beam having a wavelength not less than 650 nm.

3. The image forming apparatus of claim 1, wherein the image bearer has a half decay exposure of from 0.17 to 0.3 $\mu J/cm^2$.

4. The image forming apparatus of claim 1, wherein the metal-free phthalocyanine pigment is a T-type metal-free phthalocyanine pigment or an X-type metal-free phthalocyanine pigment.

5. The image forming apparatus of claim 1, wherein the image bearer further comprises a photosensitive layer including the charge generation layer and the charge transport layer, wherein an electric field intensity applied to the photosensitive layer is from 10 to 50 V/μm when the charger charges the image bearer.

6. The image forming apparatus of claim 1, wherein the charging member contacts the image bearer only applied with a DC bias.

7. The image forming apparatus of claim 1, wherein a difference between a first bright part potential measured when a transfer bias is applied to the transferring member and the electrostatic latent image is formed on the image bearer, and a second bright part potential measured before the surface of the image bearer is charged and after the toner image is transferred onto the transfer material is from 50 to 350 V.

* * * * *